US012618211B2

(12) United States Patent
Tatangelo

(10) Patent No.: US 12,618,211 B2
(45) Date of Patent: May 5, 2026

(54) APPARATUS FOR COLLECTION AND REMOVAL OF ANIMAL WASTE

(71) Applicant: Tanjman Innovations, LLC, Fort Lauderdale, FL (US)

(72) Inventor: Gary M. Tatangelo, Aptos, CA (US)

(73) Assignee: Tanjman Innovations, LLC, Fort Lauderdale, FL (US)

( * ) Notice: Subject to any disclaimer, the term of this patent is extended or adjusted under 35 U.S.C. 154(b) by 1083 days.

(21) Appl. No.: 17/577,945

(22) Filed: Jan. 18, 2022

(65) Prior Publication Data

US 2023/0228049 A1 Jul. 20, 2023

(51) Int. Cl.
*E01H 1/12* (2006.01)

(52) U.S. Cl.
CPC ... *E01H 1/1206* (2013.01); *E01H 2001/1226* (2013.01)

(58) Field of Classification Search
CPC ..... E01H 1/1206; E01H 2001/1226; E01H 2001/126
See application file for complete search history.

(56) References Cited

U.S. PATENT DOCUMENTS 3,703,158 A 11/1972 Lemler
3,971,503 A * 7/1976 Allan ..... B65D 5/6602 294/1.3
4,017,015 A 4/1977 Jefferson
4,103,952 A * 8/1978 Thompson ..... E01H 1/1206 294/1.3
4,230,354 A * 10/1980 Claras ..... E01H 1/1206 294/1.3
4,830,419 A 5/1989 Watanabe
5,385,376 A 1/1995 Malaspina et al.
5,392,940 A * 2/1995 Pierce ..... B65F 1/1623 220/669
5,564,762 A 10/1996 Ring
6,126,215 A * 10/2000 Jahns ..... E01H 1/1206 294/1.3
7,625,026 B2 12/2009 Lau
7,976,083 B2 7/2011 Black et al.
8,038,188 B1 * 10/2011 Nolan-Brown ..... A01K 27/006 119/796
D818,663 S 5/2018 Silcott
2003/0041809 A1 3/2003 Tsigrik
(Continued)

FOREIGN PATENT DOCUMENTS

CN 304402561 S 12/2017
CN 306219899 S 12/2020
(Continued)

*Primary Examiner* — Stephen A Vu
(74) *Attorney, Agent, or Firm* — Thompson Coburn LLP

(57) ABSTRACT

An apparatus for collection and removal of animal waste is disclosed. The collection apparatus may have a plurality of panels connected with one another by a plurality of hinges. The plurality of panels of the collection apparatus may be manipulated by a user to move the collection apparatus from a collapsed position to an expanded position. In the expanded position, a bag may line the interior of the plurality of panels to collect the animal waste. A user can then manipulate the animal waste into the bag lining the collection apparatus. The bag containing the animal waste may then be secured to the collection apparatus by way of panel clip for later disposal.

18 Claims, 20 Drawing Sheets

(56) References Cited

U.S. PATENT DOCUMENTS

| | | | |
|---|---|---|---|
| 2003/0222465 | A1 | 12/2003 | Fonfrias |
| 2005/0006914 | A1 | 1/2005 | Turner |
| 2010/0181787 | A1 | 7/2010 | Williamson |
| 2010/0237640 | A1 | 9/2010 | Chia |
| 2020/0267940 | A1 | 8/2020 | Tanner |

FOREIGN PATENT DOCUMENTS

| | | | |
|---|---|---|---|
| CN | 306566039 | S | 5/2021 |
| GB | 2249470 | A | 5/1992 |
| JP | 2004159503 | A | 6/2004 |
| TW | D194532 | S | 12/2018 |
| TW | D196467 | S | 3/2019 |
| WO | 2007095677 | A1 | 8/2007 |

* cited by examiner

APPARATUS FOR COLLECTION AND REMOVAL OF ANIMAL WASTE

INTRODUCTION

Pet ownership is an important part of the physical and emotional wellbeing for a large part of the world's population. Pets provide a large amount of love and companionship for their owners. Many individuals own pets for a variety of reasons. Be it the need to have a loyal companion at a lonely time, or to help with chores needed for their professional career, pet ownership has multiple different advantages and roles to play for the specific owners. Regardless, many pets become part of the owner's family unit and are treated and cared for as such.

With pet ownership comes the requirement to be a responsible pet owner. As many pets live in the owner's home unit, they require all care to be taken on by the owner. As such, food must be provided by owners, regular veterinary visits as required, and regular grooming help keep the pet and the bond between the pet and the owner healthy and happy. Pets come in a large variety of animals. Some might enjoy the simplicity of a fish tank display while others like the more exotic route of reptiles. Some even go so far as keeping undomesticated animals as their pets. However, the vast majority of pets throughout the world are cats and dogs. Such cat and dog owners would do anything for their pets and their pets would likewise do the same for them.

While some of these cats and dogs may make their homes outdoors on an owner's property, many of these pets will live indoors. As such, food and other requirements of ownership must occur within an enclosed space. Of course, as with any type of animal, consumption of food leads to the production of waste. Such waste must be evacuated from the body to promote a healthy lifestyle. Given that many of these pets live indoors, expelling animal waste within the indoor environment is not ideal for both the pet and the owner. Cats are creatures of habit and can be trained to use a litter box indoors for their waste disposal. Dogs, however, and some of the more exotic pets, must be taken outdoors to relieve themselves and to expel the waste.

Not all dog owners keep their canine companions outdoors. Others also do not have private property where a dog can relieve itself without possible consequences. Many of these dog owners live in cities or large urban areas where their dogs are forced to walk and relieve themselves on public property. Many, if not all, cities and municipalities require dog owners to pick up, remove, and dispose of the waste created by their animals. Refusal to do so can result in fines, or in rare cases possible imprisonment. As such, pet owners subject to these conditions are forced to carry upon themselves bags or other types of containers to pick up and then dispose of the waste created by their pets. All pet owners who wish to take their animals for walks in public parks or public trails are also subject to these type of law requirements to clean up after their pets. Overall, it is generally frowned upon in the pet ownership community to leave the waste of pets on public or private property that is not owned by the owner of the pet. Thus, a vast majority of pet owners carry plastic bags to scoop up and remove such animal waste.

While the use of disposal bags of the plastic variety is quite common to pick up and handle pet waste, their use also comes with a large number of drawbacks. Many bags and containers on the marketplace are disposable, convenient, and designed for large market production. Thus, the hygienic nature of such containers is not verified or tested to rigorous medical standards. The containers used to collect animal waste are made for efficiency and not safety. The containers do contain the waste, but the material may be porous at a microscopic level and possible harmful organisms may transfer from the waste to the owner during collecting and storing the waste within the container. Additionally, almost all of the containers on the marketplace do not contain airtight seals to confine the odor emitted from the waste. Owners collecting such waste are constantly bombarded with the smell during collection and securing of the waste within the container.

By far the biggest drawback for pet owners collecting the waste of their pets is storage. As waste collection is usually required in public areas, on walks, or within park and hiking trails, the presence of a nearby garbage can or disposal bin is rarely nearby. Thus, owners are forced to use porous containers to collect the waste and carry it with them for long periods of time. Whether the animal waste inside the container is carried by hand, within a pocket, or stored in a bag or transport vehicle like a stroller, it is not ideal for the pet owner to continually have to handle and contact the animal waste for the majority of outings. All pet owners will realize the necessity of this, yet it is an uncomfortable and unenjoyable experience for the owner to endure.

As such, the inventor proposes the following disclosure to assist pet owners in the collection and storage of the animal waste pickups needed during outings with their respective pets. The inventor's device provides a discrete container that can be easily manipulated to aid the pet owner in collecting the waste and storing the waste in an efficient manner for later disposal. The inventor's device minimizes the time the pet owner has to handle and contact the waste thereby minimizing any possible harmful effects on the owner by collection of the animal waste.

Further features and advantages of the disclosed embodiments, as well as the structure and operation of various elements of the disclosed embodiments, are described in detail below with reference to the accompanying drawings.

BRIEF DESCRIPTION OF THE DRAWINGS

The accompanying drawings, which are incorporated in and form a part of the specification, illustrate the disclosed embodiments and together with the description, serve to explain certain inventive principles.

DETAILED DESCRIPTION OF EXAMPLE EMBODIMENTS

Figure 1:
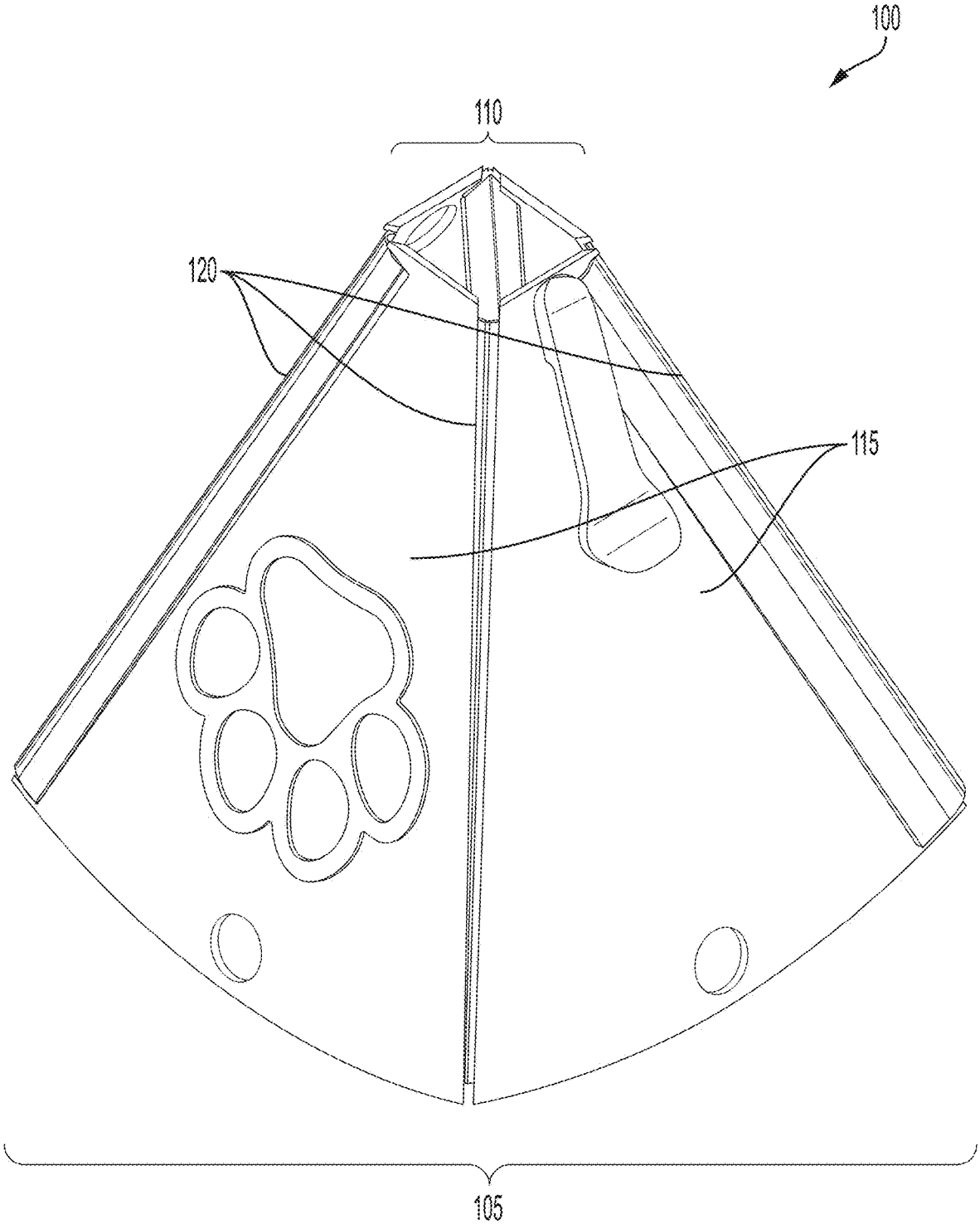
FIG. 1 shows a perspective view of a collection apparatus for containing and removal of animal waste as described herein in an embodiment of the disclosure.

Referring to the accompanying drawings, FIG. 1 illustrates a collection apparatus 100 for containing and removal of animal waste. The collection apparatus 100 may be constructed of any type of solid material which remains rigid at temperatures experienced while walking or guiding a pet. In an example embodiment of the present disclosure, the collection apparatus 100 is viewed as being made from synthetic or semi-synthetic polymers generally known as plastics. In other embodiments, wooden materials, metals, metal alloys, rigid cloth, or any other suitable material may be used in the construction of the collection apparatus 100. The material of the collection apparatus 100 performs at least two distinct purposes. First, the material of the collection apparatus 100 shields and protects the user from the animal waste that is collected during both the collection and the storage process. Second, the material of the collection apparatus 100 dictates the overall shape or form of the collection apparatus 100. During production, and dependent on the chosen material, the collection apparatus 100 may be injection molded, milled, or even printed to the designed configuration of the overall collection apparatus 100. As seen in an example embodiment of the disclosure, the collection apparatus 100 may be a polyhedron form with parts of the polyhedron being removed and filled with void space. The example embodiment shows an approximate four-sided pyramid form having a base 105 and an apex 110. The base 105 of the collection apparatus 100 has a larger width and length than the apex 110 of the collection apparatus 100. In turn, the collection apparatus 100 may have a plurality of panels 115 traveling in height from the base 105 to the apex 110. In the example embodiment of the present disclosure, the collection apparatus 100 has four panels which make up the plurality of panels 115. To connect one panel to an adjacent panel, the collection apparatus 100 employs a plurality of hinges 120. The plurality of hinges 120 may be formed from a variety of different materials, yet any materials used to connect one panel to another panel of the plurality of panels 115 should be flexible. While a plurality of hinges 120 is present with the example collection apparatus 100, other types of connections between adjacent panels of the collection apparatus 100 are possible. For example, snap fastener, metallic rings, or any other suitable flexible constructions could be used so long as the panels of the collection apparatus 100 are allowed to move along the edges where one panel meets another panel keeping to the flexible nature of the plurality of hinges 120.

The overall configuration of the collection apparatus 100 has an additional important function. The collection apparatus 100 itself is designed to be collapsible wherein the plurality of panels 115 of the collection apparatus 100 may fold onto and rest upon one another. In this manner, the collection apparatus 100 can move from a first position to a second position. In the first position, the plurality of panels 115 open up by movement via the plurality of hinges 120 to form the generally three-dimensional shape. As stated above, this shape in the example viewed in FIG. 1 is one of a four-sided pyramid. However, it should be understood that other configurations, including a greater number of panels of the plurality of panels 115, are possible so long as the plurality of panels 115 can move via the plurality of hinges 120 from the first position to the second position. Within the first position, the collection apparatus 100 has large surface area with the interior of the collection apparatus 100 being void space. In this expanded position, the collection apparatus 100 can be manipulated by the user (pet owner) to collect animal waste into the void space interior of the inside of the collection apparatus 100. In the second position, the plurality of panels 115 may rest upon one another resulting in a collapsed configuration. In the collapsed position, the collection apparatus 100 has significantly reduced surface area and does not have an overall three-dimensional appearance. Within this collapsed position, the collection apparatus 100 can be discreetly carried or stored by the user (pet owner) until its use is needed.

Figure 2:
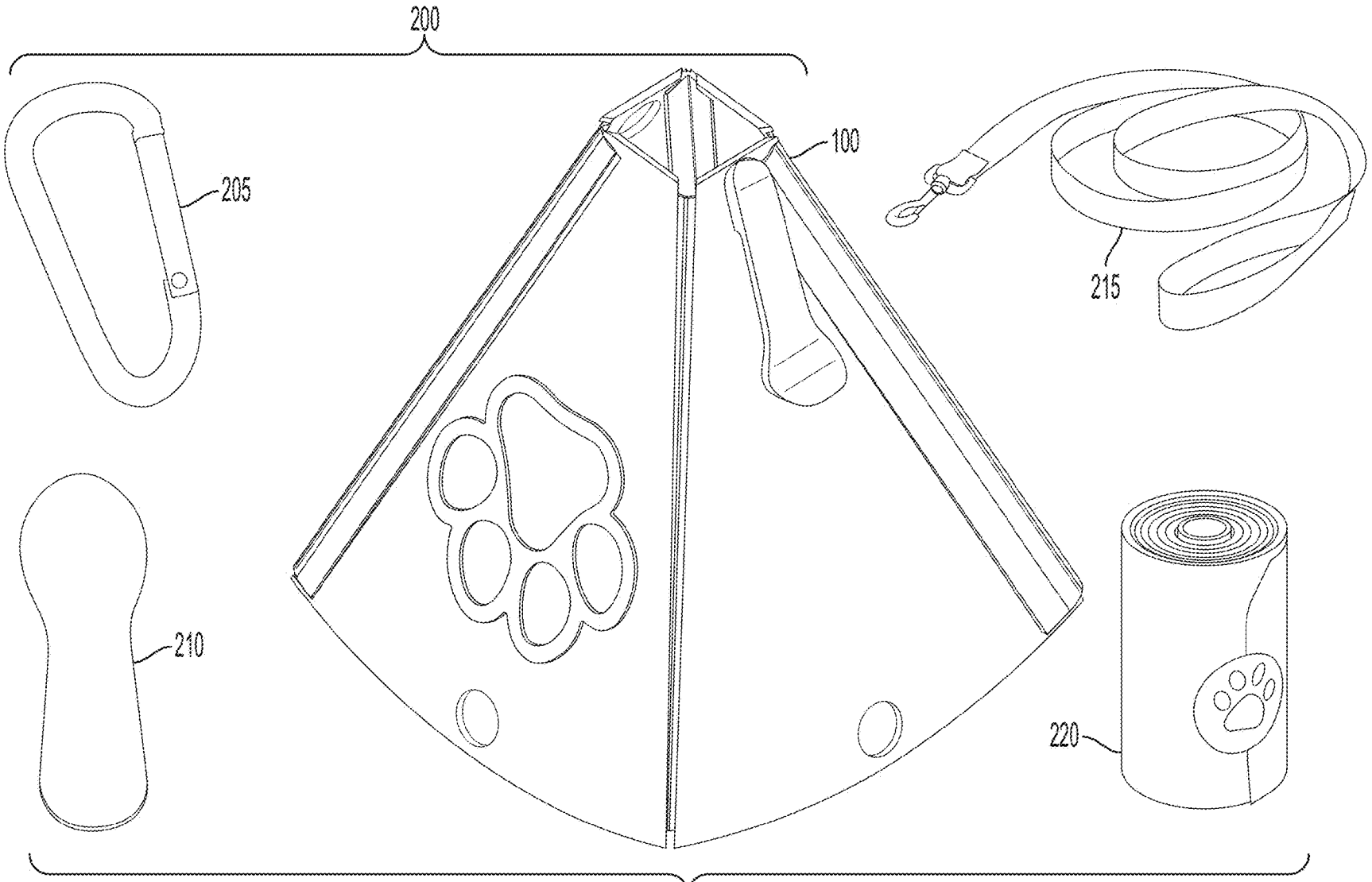
FIG. 2 shows a perspective view of kit components which may be used in conjunction with the collection apparatus for containing and removal of animal waste in an embodiment of the disclosure.

FIG. 2 shows a perspective view of kit components which may be used in conjunction with the collection apparatus 100 for containing and removal of animal waste. The collection apparatus 100 is envisioned by the inventor for use during pet ownership when collection of pet waste is desired or required by law. For example, the collection apparatus 100 may be used on walks in a city or within public parks where the pet may evacuate its bowels and clean up is required. In some embodiments, the collection apparatus 100 may be aided by these kit components to help the user remove and store the animal waste until ultimate disposal is appropriate. The collection apparatus 100 may be part of a kit 200 that includes a clip 205 and a scraper 210. The initial purchase of the collection apparatus 100 may include both the clip 205 and the scraper 210 within the same packaging. Even larger manufactured kits may include a leash 215 and a plurality of bags 220 to help collect the animal waste with the collection apparatus 100. The clip 205 works with the collection apparatus 100 such that the clip 205 can attach to the collection apparatus 100. The details of this connection to the collection apparatus 100 will be explained below in further detail. The clip 205 can attach to the collection apparatus 100 when the collection apparatus 100 is in either the first (expanded) position or the second (collapsed) position. When attached to the collection apparatus 100, the clip 205 offers the user the ability to secure the collection apparatus 100 to themselves, for example by way of a belt, belt loop, purse, or to a leash 215 used for the outdoor excursion with the pet. In this manner, the clip 205 allows the collection apparatus 100 to be inconspicuous and not a cumbersome component that additionally needs to be carried or maneuvered by the user during the outdoor excursion. The clip 205 itself may be any type of attaching device that can secure the collection apparatus 100 to another connection point. As viewed in FIG. 2 and in an example embodiment of the present disclosure, the clip 205 could be a carabiner. Of course, other types of fasteners such as snap ties, ropes, or anything of the like could be used in place of the clip as desired by the user.

Another important component of the kit 200 containing the collection apparatus 100 is the scraper 210. The scraper 210 is envisioned to be a piece of material suitable for moving and manipulating the waste from the animal into the collection apparatus 100 during operational use. For example, the scraper 210 may be made of wood and milled into a functional shape for the scraping use. Other types of materials such as plastic, paper, metal, or the like may be used for the scraper 210 and provided as part of the kit 200. However, as the scraper 210 is generally meant to be disposed of after operational use to pick up the animal waste, the inventor recommends the use of biodegradable materials such as wood. Of course, stronger other materials which can form the scraper 210, such as metal, can also remove the need for immediate disposal if that is the desire of the user. Additional scrapers 210 may be purchased by the user as required during lifetime use of the collection apparatus 100.

Figure 3:
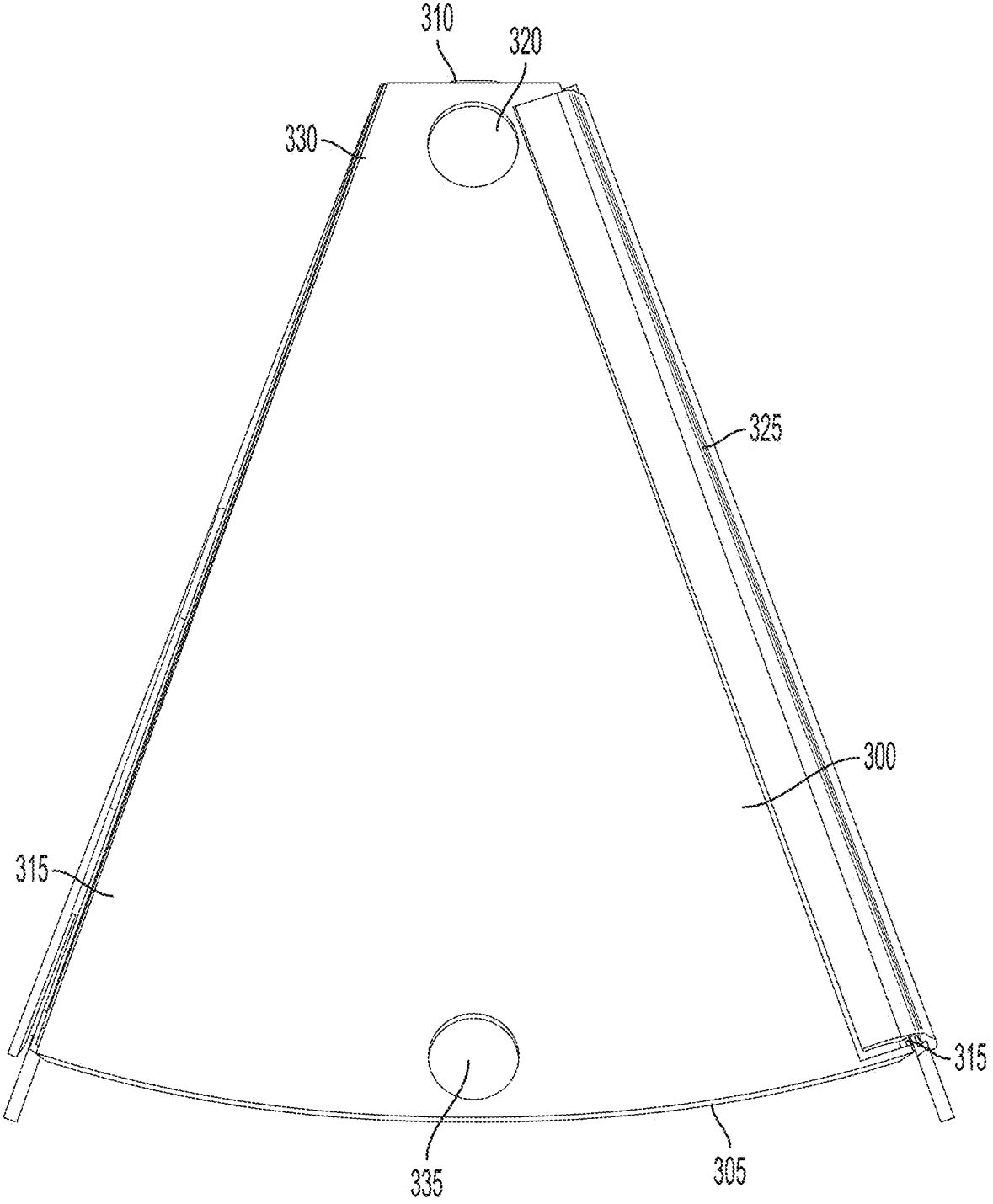
FIG. 3 shows a perspective view of a first panel of the collection apparatus for containing and removal of animal waste in an embodiment of the disclosure.

Turning to FIGS. 3-11, the details and proportions of the collection apparatus 100 are viewed with more clarity. FIG. 3 shows a first panel 300 of the collection apparatus 100 for containing and removal of animal waste in an example embodiment. The first panel 300 has a generally triangular shape having a first panel base 305, a first panel apex 310, and a pair of first panel side edges 315. The thickness of the first panel 300 can vary, but it should be thick enough to provide rigidity of the first panel 300 in both the collapsed and expanded positions of the collection apparatus 100. In the viewed example embodiment, the thickness of the first panel may be approximately 0.06 inches. The first panel apex 310 occurs below an imaginary point where the pair of first panel side edges 315 would meet if they continued upward. The first panel apex 310 is generally straight and flat. In the viewed example embodiment, the width of the first panel apex 310 may be approximately 0.75 inches, but different widths are possible. Below the first panel apex 310 is an apex opening 320. The apex opening 320 is centered about the width of the first panel apex 310. The apex opening 320 should be big enough to accommodate a clip 205, not seen on FIG. 3 but described in FIG. 2. A clip 205 can attach to the apex opening 320 allowing the user to secure the collection apparatus 100 as desired. The apex opening 320 is only available and accessible for attachment of the clip 205 when the collection apparatus 100 is in the expanded position. Otherwise, in the collapsed position, the apex opening 320 is obscured by the other panels of the plurality of panels 115 indicating to the user that it is not the correct opening for clip 205 attachment in such a position.

The bottom of the first panel 300 has the first panel base 305. The first panel base 305 is a bit different when compared to the first panel apex 310. The first panel base 305 is slightly curved as it travels between the pair of first panel side edges 315. Due to this curvature, the length of the first panel 300 through the center may be longer than the length of the pair of first panel side edges. In the viewed example embodiment, the width of the first panel base 305 may be between approximately 3.19 to 3.85 inches and different widths are possible. Due to the varying nature in size of different pets, some small and some large, different overall sizes of the collection apparatus 100 may be produced. Because of these differing sizes, the overall width of the first panel base 305 can be adjusted to enlarge or shrink the overall interior void space of the collection apparatus 100 in the expanded position. Concurrently, each of the pair of first panel side edges 315 can also increase or decrease depending on the model version of the collection apparatus 100.

At the bottom of the first panel 300 and above the first panel base 305, a first panel opening 335 may be present. The first panel opening 335 is centered about the width of the first panel base 305. The first panel opening 335 should be big enough to accommodate a clip 205, not seen on FIG. 3 but described in FIG. 2. A clip 205 can attach to the first panel opening 335 allowing the user to secure the collection apparatus 100 as desired. The first panel opening 335 is available and accessible for attachment of the clip 205 when the collection apparatus 100 is in either the collapsed position or expanded position. However, attachment of the clip 205 to the first panel opening 335 is envisioned primarily when the collection apparatus 100 is in the collapsed position. Within the collapsed position, the first panel opening 335 will align with the respective openings existing on the other panels of the collection apparatus 100 such that attachment of the clip 205 through the first panel opening 335 will secure all panels of the collection apparatus 100 with the clip 205. The user can then desire where to discretely attach the clip 205 containing the collection apparatus 100 when it is not in operational use.

To connect the first panel 300 to its adjacent panels, a pair of hinges from the plurality of hinges 120 are used. On one first panel side edge 315, an exterior hinge 325 may be present. The exterior hinge 325 is located on and attached to the exterior side of the first panel 300. Attachment to the first panel 300 can be by any known attachment means, but adhesive use was found to be sufficient. In the example embodiment viewed in FIG. 3, the exterior hinge 325 is a bi-folding type hinge although different types of hinges are envisioned. The exterior hinge 325 is large enough so that when the collection apparatus 100 moves from the expanded position to the collapsed position, the panel attached on the other side of the exterior hinge 325 can fold upon and rest upon the exterior face of the first panel 300.

On the second first panel side edge 315 of the first panel 300, an interior hinge 330 is present. The interior hinge 330 connects the first panel 300 to its adjacent panel. The interior hinge 330 can be attached to the first panel 300 by any known attachment means, but adhesive use was found to be sufficient. The interior hinge 330 is located and attached to the interior side of the first panel. In the example embodiment viewed in FIG. 3, the interior hinge 330 is an "L" type hinge although different types of hinges are envisioned. In operation when moving from the expanded position to the collapsed position of the collection apparatus 100, the interior hinge 330 allows the connected panel to the first panel 300 the ability to fold onto itself thereby allowing the adjacent panel to rest on the interior of the first panel 300 in the collapsed position.

Figure 4:
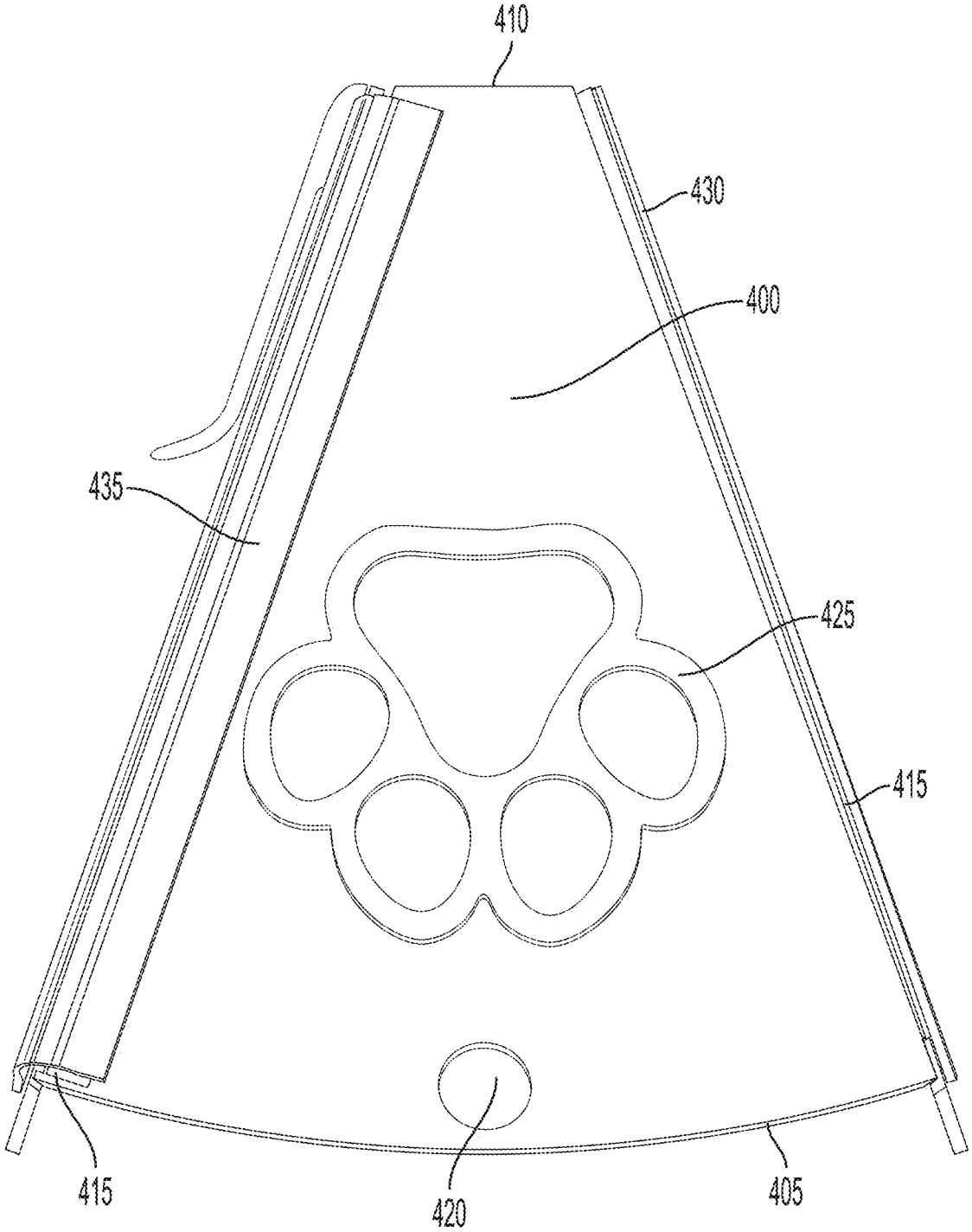
FIG. 4 shows a perspective view of a second panel of the collection apparatus for containing and removal of animal waste in an embodiment of the disclosure.

FIG. 4 shows a second panel 400 of the collection apparatus 100 for containing and removal of animal waste in an example embodiment. The second panel 400 has a generally triangular shape similar to the other panels of the collection apparatus 100 and has a second panel base 405, a second panel apex 410, and a pair of second panel side edges 415. The thickness of the second panel 400 can vary, but it should be thick enough to provide rigidity of the second panel 400 in both the collapsed and expanded positions of the collection apparatus 100. In the viewed example embodiment, the thickness of the second panel 400 may be approximately 0.06 inches. The second panel apex 410 occurs below an imaginary point where the pair of second panel side edges 415 would meet if they continued upward. The second panel apex 410 is generally straight and flat. In the viewed example embodiment, the width of the second panel apex 410 may be approximately 0.75 inches, but different widths are possible.

The bottom of the second panel 400 has the second panel base 405. The second panel base 405 is a bit different when compared to the second panel apex 410. The second panel base 405 is slightly curved as it travels between the pair of second panel side edges 415. Due to this curvature, the length of the second panel 400 through the center may be longer than the length of the pair of second panel side edges 415. In the viewed example embodiment, the width of the second panel base 405 may be between approximately 3.19 to 3.85 inches and different widths are possible. Due to the varying nature in size of different pets, some small and some large, different overall sizes of the collection apparatus 100 may be produced. Because of these differing sizes, the overall width of the second panel base 405 can be adjusted to enlarge or shrink the overall interior void space of the collection apparatus 100 in the expanded position. Concurrently, each of the pair of second panel side edges 415 can also increase or decrease depending on the model version of the collection apparatus 100.

At the bottom of the second panel 400 and above the second panel base 405, a second panel opening 420 may be present. The second panel opening 420 is centered about the width of the second panel base 405. The second panel opening 420 should be big enough to accommodate a clip 205, not seen on FIG. 4 but described in FIG. 2. The clip 205 can attach to the second panel opening 420 allowing the user to secure the collection apparatus 100 as desired. The second panel opening 420 is available and accessible for attachment of the clip 205 when the collection apparatus 100 is in either the collapsed position or expanded position. However, attachment of the clip 205 to the second panel opening 420 is envisioned primarily when the collection apparatus 100 is in the collapsed position. Within the collapsed position, the second panel opening 420 will align with the respective openings existing on the other panels of the collection apparatus 100 such that attachment of the clip 205 through the second panel opening 420 will secure all panels of the collection apparatus 100 with the clip 205. The user can then desire where to discretely attach the clip 205 containing the collection apparatus 100 when it is not in operational use.

In the middle of the second panel 400 a design 425 is present. The design 425 may take any type of format including an image, lettering, or even a brand affiliation for the collection apparatus 100. As viewed in FIG. 4, the design 425 of the second panel 400 is that of an animal paw. The design 425 itself does not purely exist for aesthetic reasons. While that is an additional advantage, the design 425 protrudes out from the exterior surface of the second panel 400. This protrusion is not large, for example 0.03 inches in the viewed embodiment, but the protrusion allows for a gripping surface for the user to hold the collection apparatus 100 when it is used. Due to the tapered design of the collection apparatus 100 in the expanded position, it could be difficult for a user to hold the collection apparatus steady for proper collection of the animal waste into the interior void space. Thus, the protrusion of the design 425 is present to allow the user a gripping surface for the fingers of the user to steadily hold the collection apparatus 100 during operational use.

To connect the second panel 400 to its adjacent panels, a pair of hinges from the plurality of hinges 120 are used. On one second panel side edge 415, an interior hinge 430 is present. The interior hinge 430 connects the second panel 400 to the first panel 300 and is the same interior hinge noted in FIG. 3 as element 330. The interior hinge 430 can be attached to the second panel 400 by any known attachment means, but adhesive use was found to be sufficient. The interior hinge 430 is located and attached to the interior side of the second panel 400. In the example embodiment viewed in FIG. 4, the interior hinge 430 is an "L" type hinge although different types of hinges are envisioned. In operation when moving from the expanded position to the collapsed position of the collection apparatus 100, the interior hinge 430 allows the first panel 300 the ability to fold onto and rest against the interior of the second panel 400 in the collapsed position.

On the other second panel side edge 415 of the second panel 400, a broad hinge 435 may be present. The broad hinge 435 is larger than the other hinges present on the collection apparatus 100. Additionally, the broad hinge 435 is located on and attached to the exterior side of the second panel 400. Attachment to the second panel 400 can be by any known attachment means, but adhesive use was found to be sufficient. The broad hinge 435 is large enough so that when the collection apparatus 100 moves from the expanded position to the collapsed position, the exterior hinge 325 can fold into and be enclosed by the broad hinge 435. Thus, the broad hinge 435 should be of sufficient size to accommodate the collapse of the plurality of panels 115 onto each other in the second position of the collection apparatus 100.

Figure 5:
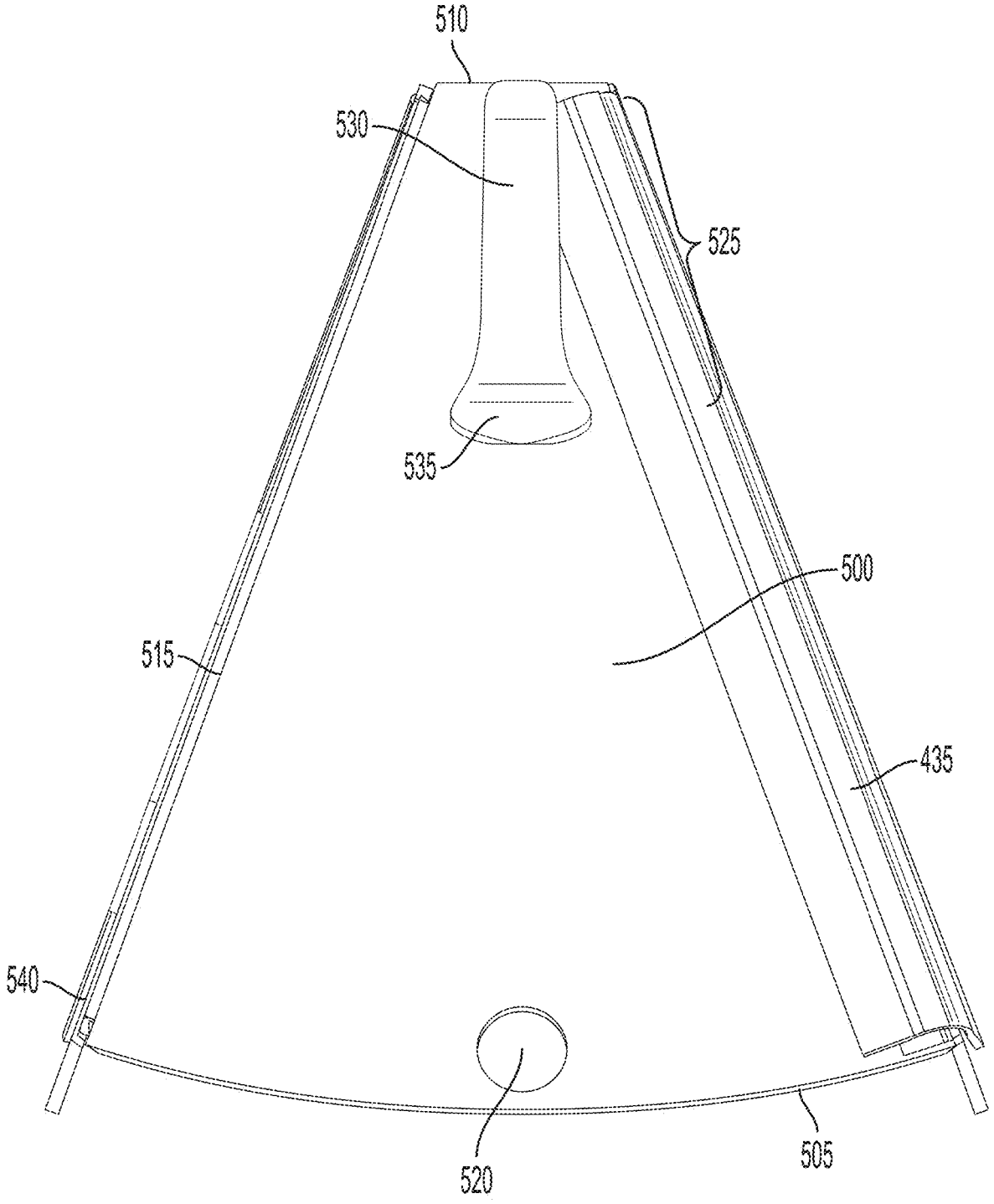
FIG. 5 shows a perspective view of a third panel of the collection apparatus for containing and removal of animal waste in an embodiment of the disclosure.

FIG. 5 shows a third panel 500 of the collection apparatus 100 for containing and removal of animal waste in an example embodiment. The third panel 500 has a generally triangular shape similar to the other panels of the collection apparatus 100 and has a third panel base 505, a third panel apex 510, and a pair of third panel side edges 515. The thickness of the third panel 500 can vary, but it should be thick enough to provide rigidity of the third panel 500 in both the collapsed and expanded positions of the collection apparatus 100. In the viewed example embodiment, the thickness of the third panel 500 may be approximately 0.06 inches. The third panel apex 510 occurs below an imaginary point where the pair of third panel side edges 515 would meet if they continued upward. The third panel apex 510 is generally straight and flat. In the viewed example embodiment, the width of the third panel apex 410 may be approximately 0.75 inches, but different widths are possible.

The bottom of the third panel 500 has the third panel base 505. The third panel base 505 is a bit different when compared to the third panel apex 510. The third panel base 505 is slightly curved as it travels between the pair of third panel side edges 515. Due to this curvature, the length of the third panel 500 through the center may be longer than the length of the pair of third panel side edges 515. In the viewed example embodiment, the width of the third panel base 505 may be between approximately 3.19 to 3.85 inches and different widths are possible. Due to the varying nature in size of different pets, some small and some large, different overall sizes of the collection apparatus 100 may be produced. Because of these differing sizes, the overall width of the third panel base 505 can be adjusted to enlarge or shrink the overall interior void space of the collection apparatus 100 in the expanded position. It is important though that all panels of the collection apparatus 100 are the same uniform shape and size for collapsibility purposes. Concurrently, each of the pair of third panel side edges 515 can also increase or decrease depending on the model version of the collection apparatus 100.

At the bottom of the third panel 500 and above the third panel base 505, a third panel opening 520 may be present. The third panel opening 520 is centered about the width of the third panel base 505. The third panel opening 520 should be big enough to accommodate a clip 205, not seen on FIG. 5 but described in FIG. 2. The clip 205 can attach to the third panel opening 520 allowing the user to secure the collection apparatus 100 as desired. The third panel opening 520 is available and accessible for attachment of the clip 205 when the collection apparatus 100 is in either the collapsed position or expanded position. However, attachment of the clip 205 to the third panel opening 520 is envisioned primarily when the collection apparatus 100 is in the collapsed position. Within the collapsed position, the third panel opening 520 will align with the respective openings existing on the other panels of the collection apparatus 100 such that attachment of the clip 205 through the third panel opening 520 will secure all panels of the collection apparatus 100 with the clip 205. The user can then desire where to discretely attach the clip 205 containing the collection apparatus 100 when it is not in operational use.

At the top of the third panel 500 and below the third panel apex 510 is panel clip 525. The panel clip may be made of the same material used to construct the plurality of panels 115 or can be made from a different material and affixed to the exterior side of the third panel 500. While the panel clip 525 is viewed in the example on the third panel 500, it may be present on a different panel in a different operational configuration of the collection apparatus 100. The panel clip 525 has a dual use. First, a bag or other outside container holding the animal waste can be secured to the third panel 500 and in turn the collection apparatus 100. Second, the panel clip 525 can be used to clip on to the user or a user accessory as a means to hold the collection apparatus when not in use and for storage purposes. The panel clip 525 may have both a resilient member 530 and a tab extension 535. The resilient member 530 is an elongated structure under which a bag or container may be secured to the exterior of the third panel 500 or to a user. The resilient member 530 of the panel clip 525 wishes to stay as close to the third panel 500 exterior face as possible. Be it through tension of the material used to form the resilient member 530 and the panel clip 525 or through use of an outside component such as a spring. As viewed in the example of FIG. 5, the resilient member 530 of the third panel 500 may be approximately 1.8 inches in length. At the end furthest from the third panel apex 510, a tab extension 535 may be present at the termination of the resilient member 530. The tab extension 535 protrudes outwards away from the resilient member 530. This protrusion helps guide a bag or container underneath the resilient member 530 so that it is secured to the exterior face of the third panel 500. In the example embodiment, the tab extension is approximately 0.36 inches from the exterior of the third panel 500, but other distances are possible.

To connect the third panel 500 to its adjacent panels, a pair of hinges from the plurality of hinges 120 are used. On one third panel side edge 515, a broad hinge 435 may be present. The broad hinge 435 is larger than the other hinges present on the collection apparatus 100. Additionally, the broad hinge 435 is located on and attached to the exterior side of the third panel 500. Attachment to the third panel 500 can be by any known attachment means, but adhesive use was found to be sufficient. The other side of the broad hinge 435 is attached to the second panel 400 described above. The broad hinge 435 is large enough so that when the collection apparatus 100 moves from the expanded position to the collapsed position, the exterior hinge 325 can fold into and be enclosed by the broad hinge 435. Thus, the broad hinge 435 should be of sufficient size to accommodate the collapse of the plurality of panels 115 onto each other in the second position of the collection apparatus 100.

On the second third panel side edge 515 of the third panel 500, a second interior hinge 540 is present. The second interior hinge 540 connects the third panel 500 to an adjacent panel. The second interior hinge 540 is similar to the earlier described interior hinge 330 and can be attached to the third panel 500 by any known attachment means, including adhesive. The second interior hinge 540 is located and attached to the interior side of the third panel 500. In the example embodiment viewed in FIG. 5, the second interior hinge 540 is an "L" type hinge although different types of hinges are envisioned. In operation when moving from the expanded position to the collapsed position of the collection apparatus 100, the second interior hinge 540 allows the third panel 500 the ability to fold onto and rest against the interior of the adjacent panel in the collapsed position.

Figure 6:
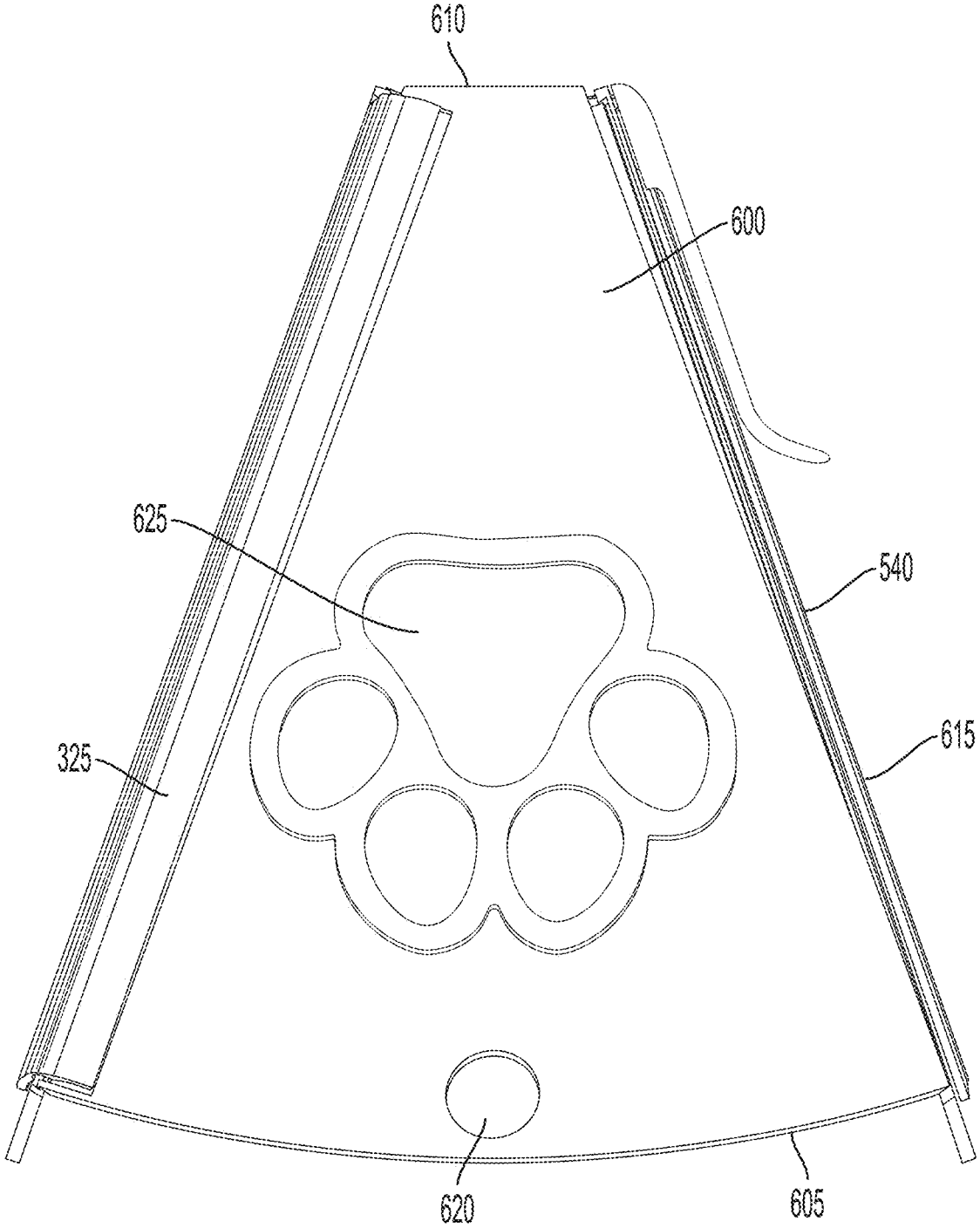
FIG. 6 shows a perspective view of a fourth panel of the collection apparatus for containing and removal of animal waste in an embodiment of the disclosure.

FIG. 6 shows a fourth panel 600 and the final panel of the collection apparatus 100 for containing and removal of animal waste in an example embodiment. The fourth panel 600 has a generally triangular shape similar to the other panels of the collection apparatus 100 and has a fourth panel base 605, a fourth panel apex 610, and a pair of fourth panel side edges 615. The thickness of the fourth panel 600 can vary, but it should be thick enough to provide rigidity of the fourth panel 600 in both the collapsed and expanded positions of the collection apparatus 100. In the viewed example embodiment, the thickness of the fourth panel 600 may be approximately 0.06 inches. The fourth panel apex 610 occurs below an imaginary point where the pair of fourth panel side edges 615 would meet if they continued upward. The fourth panel apex 610 is generally straight and flat. In the viewed example embodiment, the width of the fourth panel apex 610 may be approximately 0.75 inches, but different widths are possible.

The bottom of the fourth panel 600 has the fourth panel base 605. The fourth panel base 605 is a bit different when compared to the fourth panel apex 610. The fourth panel base 605 is slightly curved as it travels between the pair of fourth panel side edges 615. Due to this curvature, the length of the fourth panel 600 through the center may be longer than the length of the pair of fourth panel side edges 615. In the viewed example embodiment, the width of the fourth panel base 605 may be between approximately 3.19 to 3.85 inches and different widths are possible. Due to the varying nature in size of different pets, some small and some large, different overall sizes of the collection apparatus 100 may be produced. Because of these differing sizes, the overall width of the fourth panel base 605 can be adjusted to enlarge or shrink the overall interior void space of the collection apparatus 100 in the expanded position. It is important though that all panels of the collection apparatus 100 are the same uniform shape and size for collapsibility purposes. Concurrently, each of the pair of fourth panel side edges 615 can also increase or decrease depending on the model version of the collection apparatus 100.

At the bottom of the fourth panel 600 and above the fourth panel base 605, a fourth panel opening 620 may be present. The fourth panel opening 620 is centered about the width of the fourth panel base 605. The fourth panel opening 620 should be big enough to accommodate a clip 205, not seen on FIG. 6 but described in FIG. 2. The clip 205 can attach to the fourth panel opening 620 allowing the user to secure the collection apparatus 100 as desired. The fourth panel opening 620 is available and accessible for attachment of the clip 205 when the collection apparatus 100 is in either the collapsed position or expanded position. However, attachment of the clip 205 to the fourth panel opening 620 is envisioned primarily when the collection apparatus 100 is in the collapsed position. Within the collapsed position, the fourth panel opening 620 will align with the respective openings existing on the other panels of the collection apparatus 100 such that attachment of the clip 205 through the fourth panel opening 620 will secure all panels of the collection apparatus 100 with the clip 205. The user can then desire where to discretely attach the clip 205 containing the collection apparatus 100 when it is not in operational use.

In the middle of the fourth panel 600 a second design 625 is present. The second design 625 may take any type of format including an image, lettering, or even a brand affiliation for the collection apparatus 100. The second design 625 may also be the same as the design 425 viewed on the second panel 400. As viewed in FIG. 6, the second design 625 of the fourth panel 600 is that of an animal paw. The second design 625 itself does not purely exist for aesthetic reasons. While that is an additional advantage, the second design 625 protrudes out from the exterior surface of the fourth panel 600. This protrusion is not large, for example 0.03 inches in the viewed embodiment, but the protrusion allows for a gripping surface for the user to hold the collection apparatus 100 when it is used. Due to the tapered design of the collection apparatus 100 in the expanded position, it could be difficult for a user to hold the collection apparatus steady for proper collection of the animal waste into the interior void space. Thus, the protrusion of the second design 625 is present to allow the user a gripping surface for the fingers of the user to steadily hold the collection apparatus 100 during operational use.

To connect the fourth panel 600 to its adjacent panels, a pair of hinges from the plurality of hinges 120 are used. On one fourth panel side edge 615, a second interior hinge 540 is present. The second interior hinge 540 connects the third panel 500 to the fourth panel 600. The second interior hinge 540 is similar to the earlier described interior hinge 330 and can be attached to the fourth panel 600 by any known attachment means, including adhesive. The second interior hinge 540 is located and attached to the interior side of the fourth panel 600. In the example embodiment viewed in FIG. 6, the second interior hinge 540 is an "L" type hinge although different types of hinges are envisioned. In operation when moving from the expanded position to the collapsed position of the collection apparatus 100, the second interior hinge 540 allows the fourth panel 600 the ability to fold onto and rest against the interior of the third panel 500 in the collapsed position.

On the second fourth panel side edge 615 of the fourth panel 600, an exterior hinge 325 may be present. The exterior hinge 325 is located on and attached to the exterior side of the first panel 300. Attachment to the first panel 300 can be by any known attachment means, but adhesive use was found to be sufficient. In the example embodiment viewed in FIG. 6, the exterior hinge 325 is a bi-folding type hinge although different types of hinges are envisioned. The exterior hinge 325 is large enough so that when the collection apparatus 100 moves from the expanded position to the collapsed position, the first panel 300 attached on the other side of the exterior hinge 325 can fold upon and rest upon the exterior face of the fourth panel 600.

Figure 7:
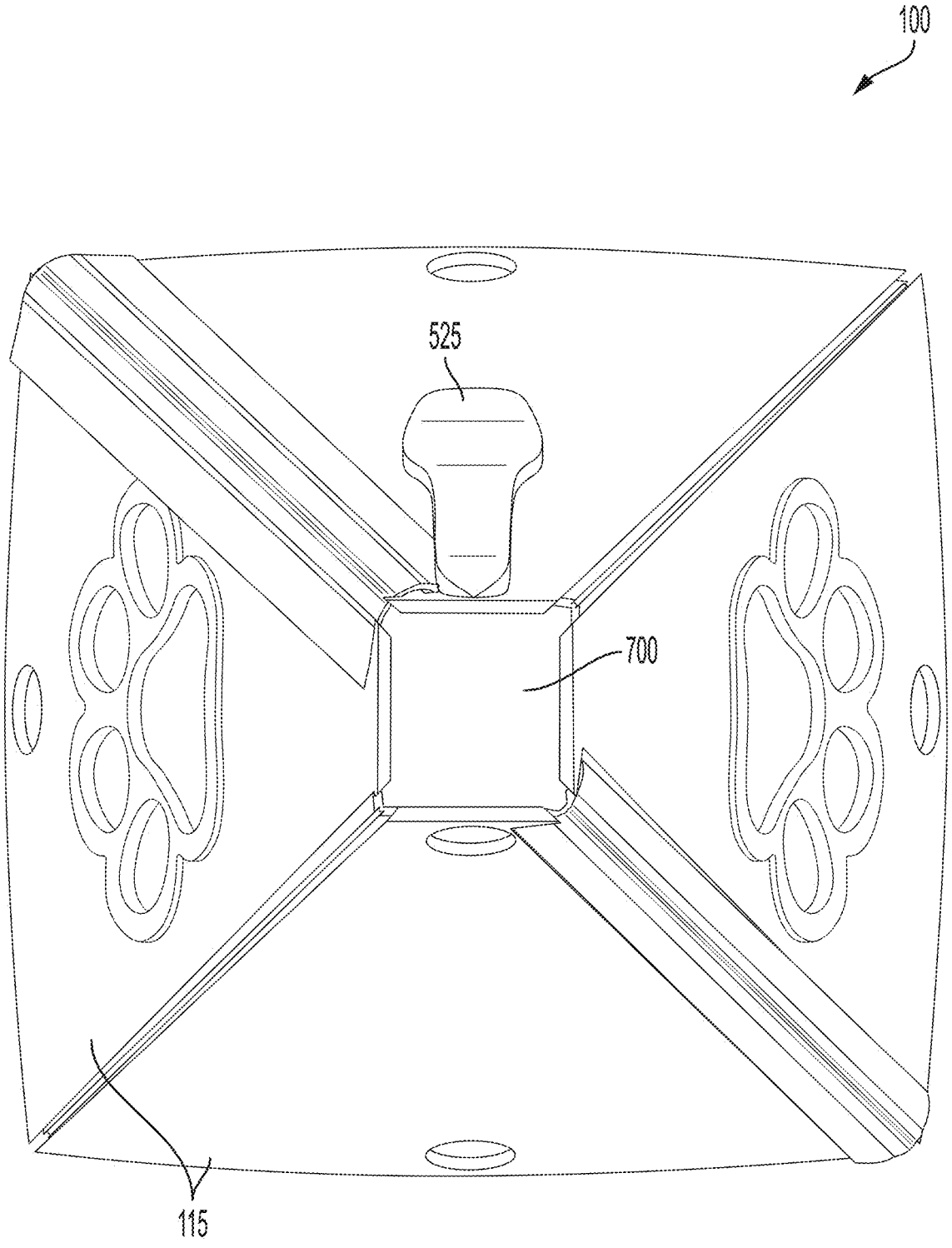
FIG. 7 shows a top view of the collection apparatus for containing and removal of animal waste in an embodiment of the disclosure.

FIG. 7 shows the collection apparatus 100 from a top-down view. The collection apparatus viewed in FIG. 7 is in the expanded position for the collection of animal waste. While in the expanded position, the collection apparatus 100 forms a central void 700 in the middle where each of the plurality of panels 115 meet at their respective apexes. The central void 700 may be a square shape or any other shape able to accommodate a part of a bag or a container passing through the central void 700. The bag or container passing through the void can then be attached to the collection apparatus by way of the panel clip 525. The embodiment viewed in FIG. 7 is a square shaped void with each side of the void being approximately 0.75 inches in length. The central void 700 only exists in the expanded position. In the collapsed position of the collection apparatus 100 as the plurality of panels 115 rest upon one another the central void 700 is absent.

Figure 8:
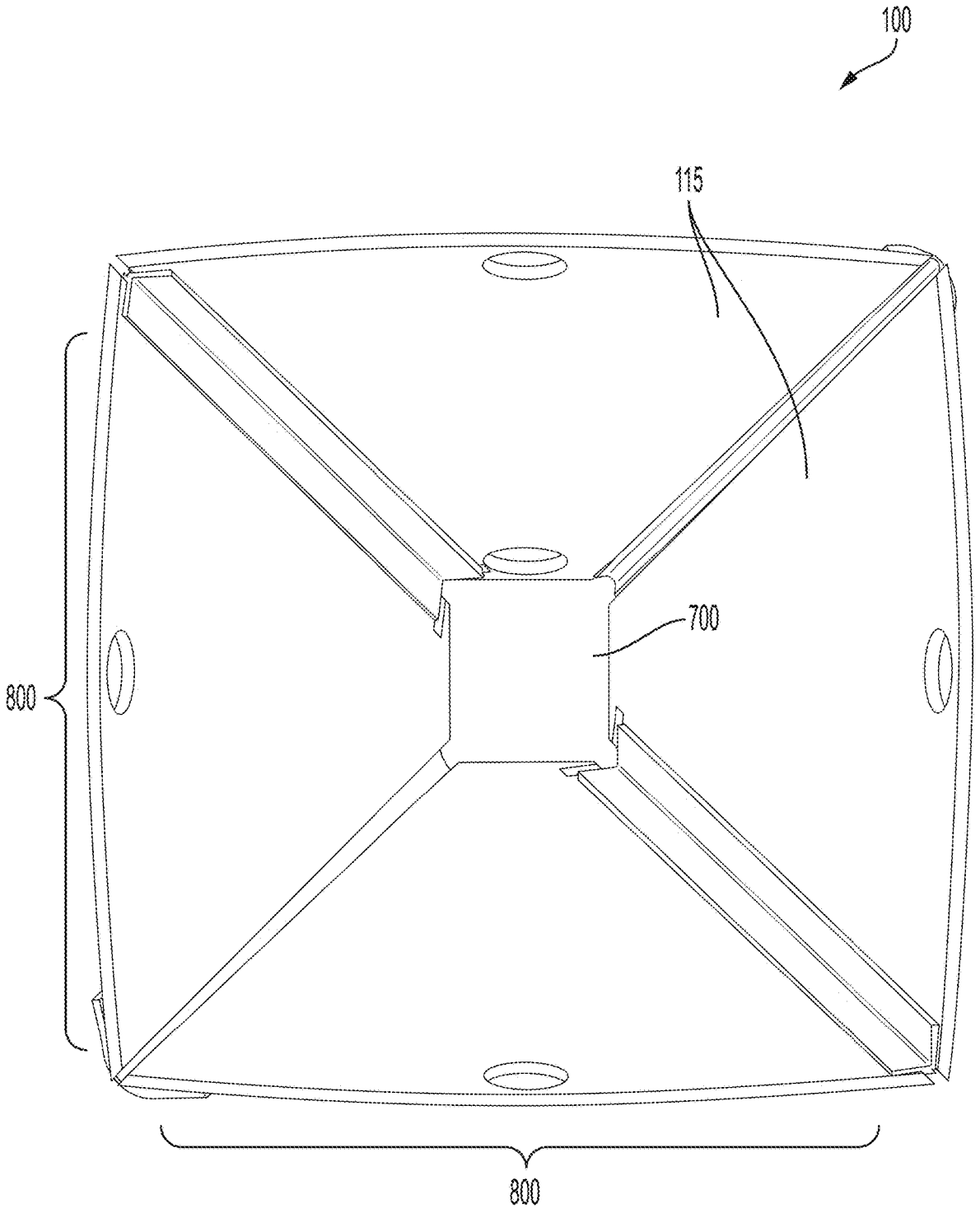
FIG. 8 shows a bottom view of the collection apparatus for containing and removal of animal waste in an embodiment of the disclosure.

FIG. 8 shows the collection apparatus 100 from a bottom-up view. The collection apparatus viewed in FIG. 8 is in the expanded position for the collection of animal waste. While in the expanded position, the collection apparatus 100 forms an interior void space 800. The interior void space 800 starts at the respective bases of the plurality of panels 115 and extends to the central void 700. The interior void space 800 is bounded by the first panel 300, second panel 400, third panel 500, and fourth panel 600 as well as the interior hinge 330, the second interior hinge 540, the exterior hinge 325, and the broad hinge 435. The interior void space 800 creates an area where the bag or the container can be placed to rest against the plurality of panels 115 by the user. While grasping the collection apparatus 100, the user can then manipulate the animal waste into the bag or container lining the interior void space 800 to secure the animal waste into the bag. The interior void space 800 also acts as a funneled cup to keep the animal waste within the bag during collection while the user works to secure the top of the container or the bag for eventual disposal.

Figure 9:
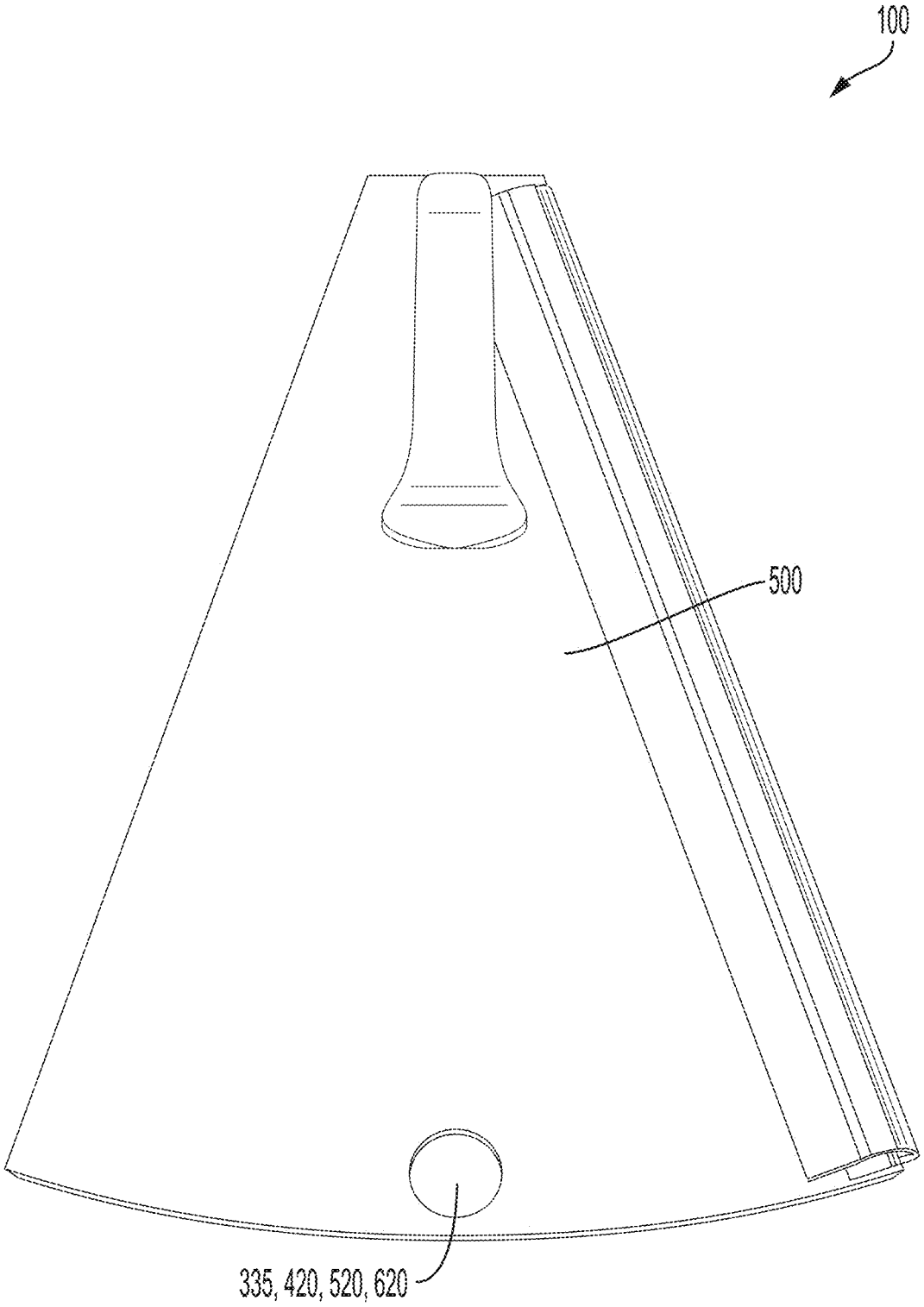
FIG. 9 shows a perspective view of the third panel of the collection apparatus for containing and removal of animal waste in a collapsed position in an embodiment of the disclosure.
Figure 10:
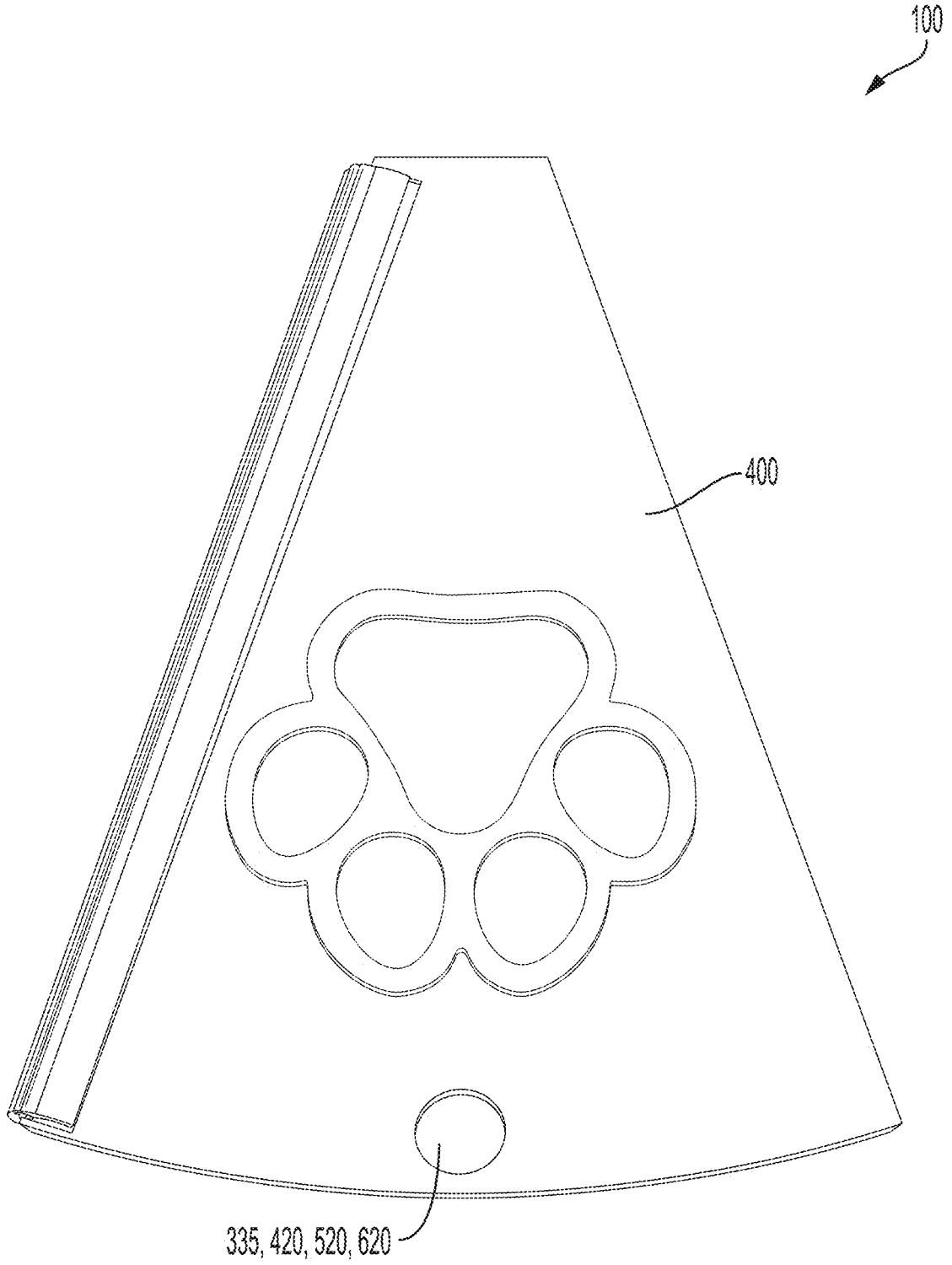
FIG. 10 shows a perspective view of the second panel of the collection apparatus for containing and removal of animal waste in a collapsed position in an embodiment of the disclosure.
Figure 11:
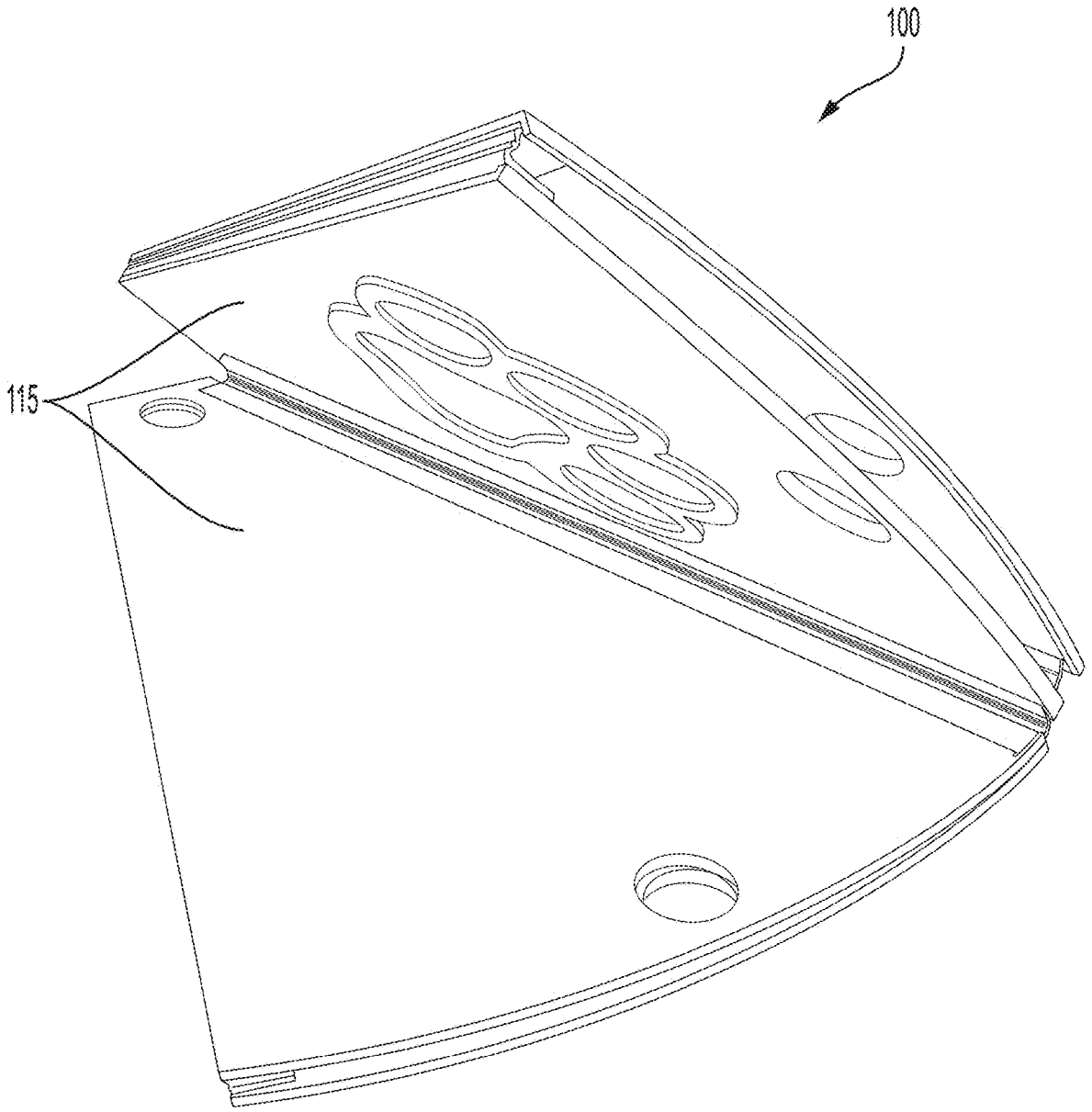
FIG. 11 shows a perspective view of the collection apparatus for containing and removal of animal waste in a partially collapsed position in an embodiment of the disclosure.
Figure 12:
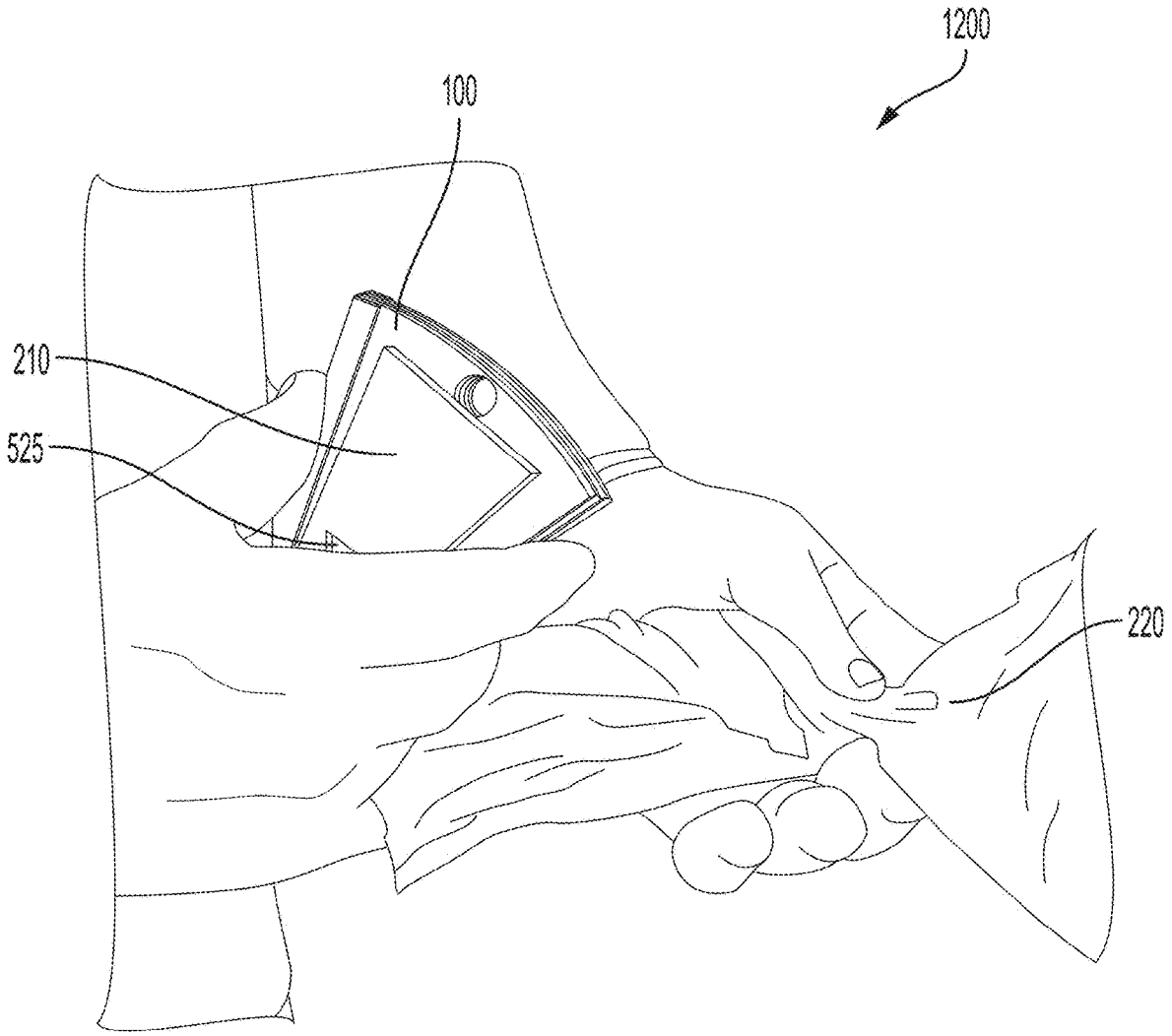
FIG. 12 shows a first operational view of the collection apparatus for containing and removal of animal waste with select kit components in an embodiment of the disclosure.
Figure 13:
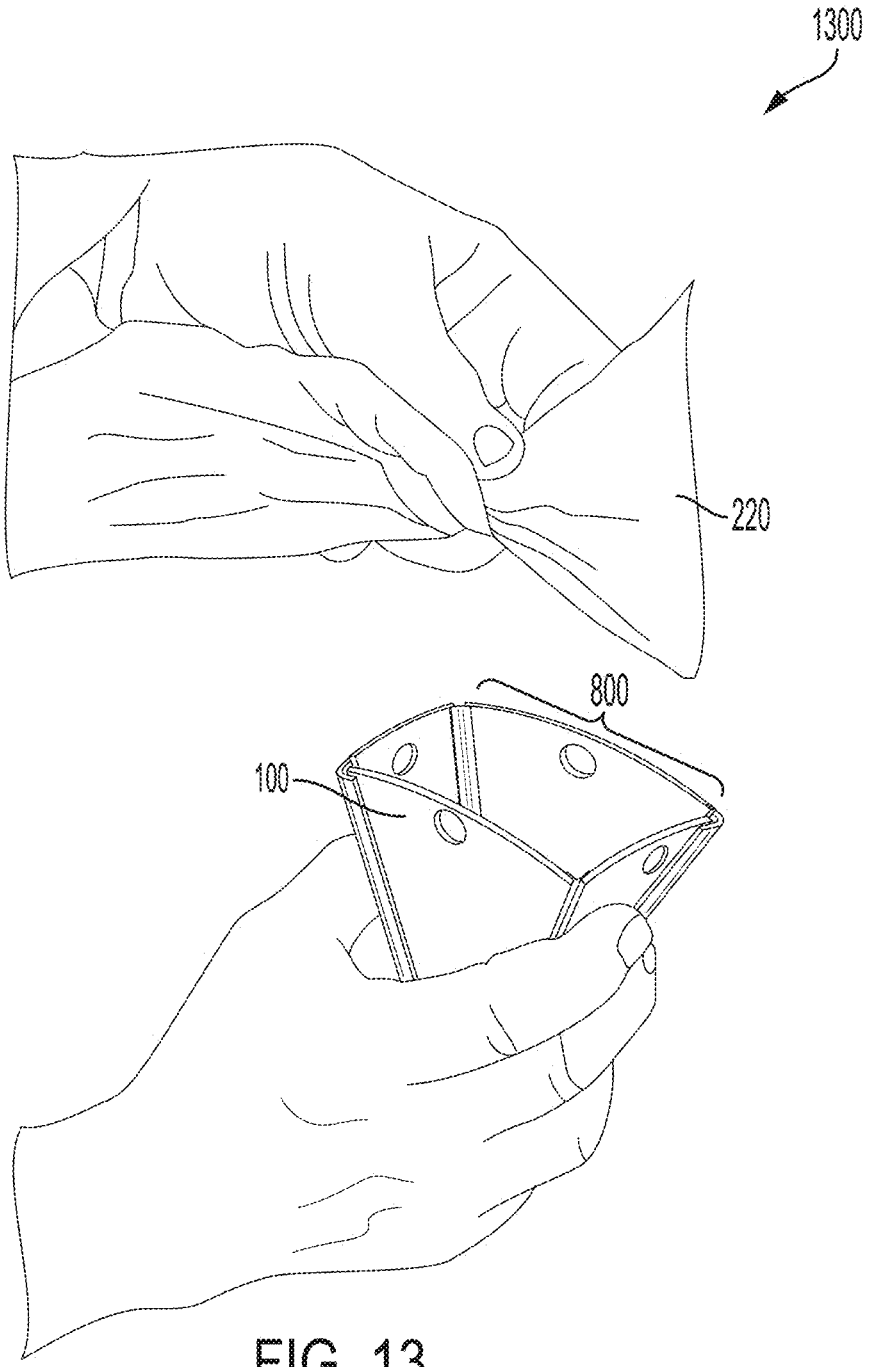
FIG. 13 shows a second operational view of the collection apparatus for containing and removal of animal waste with select kit components in an embodiment of the disclosure.

FIGS. 9 through 11 show the collection apparatus 100 in a collapsed or partially collapsed position. As viewed in FIG. 9, the collection apparatus 100 is in the collapsed position. In this view, the third panel 500 of the plurality of panels 115 is shown. In FIG. 10, the collection apparatus is also in a collapsed position. In the view of FIG. 10, the second panel 400 of the plurality of panels 115 is shown. In the collapsed position, each the first panel opening 335, second panel opening 420, third panel opening 520, and fourth panel opening 620 align with one another. This alignment creates a passageway through which a clip 205 can pass. The clip 205 can then keep the collection apparatus 100 contained in the collapsed position and also allow for storage of the collection apparatus 100 when it is not in use. As seen in FIG. 11, the collection apparatus 100 is in a partially collapsed position. If the collection apparatus 100 is not secured by a clip 205 through the multiple openings viewed on the plurality of panels 115, the elasticity and flexibility of the plurality of hinges 120 may attempt to open the collection apparatus 100 slightly. Through continued use of the collection apparatus 100 as the elasticity of the plurality of hinges mellows, the collection apparatus 100 may revert to the completely collapsed position viewed in FIGS. 9 and 10 without the additional aid of the clip 205.

FIGS. 12 through 20 illustrate the operational use of the collection apparatus 100 for the retrieval and containing of animal waste. During operation, use of the collection apparatus 100 starts with the first operational view 1200 viewed in FIG. 12. When the pet is out for a walk and creates the animal waste, the user may remove the collection apparatus 100 from the storage position. The collection apparatus 100 could be carried in a purse or bag or the like or alternatively connected to a leash 215 by way of a clip 205 through the appropriate multiple openings viewed on the plurality of panels 115. The user will then expand the collection apparatus 100 in one hand while holding a bag 220 or other type of collection container in the other hand. In the expanded position of the collection apparatus 100 and during operational use, the scraper 210 can be present on the collection apparatus 100. In this example embodiment, the scraper 210 has more of a trapezoidal configuration and is secured in place by the panel clip 525 on the side of the collection apparatus 100.

Figure 14:
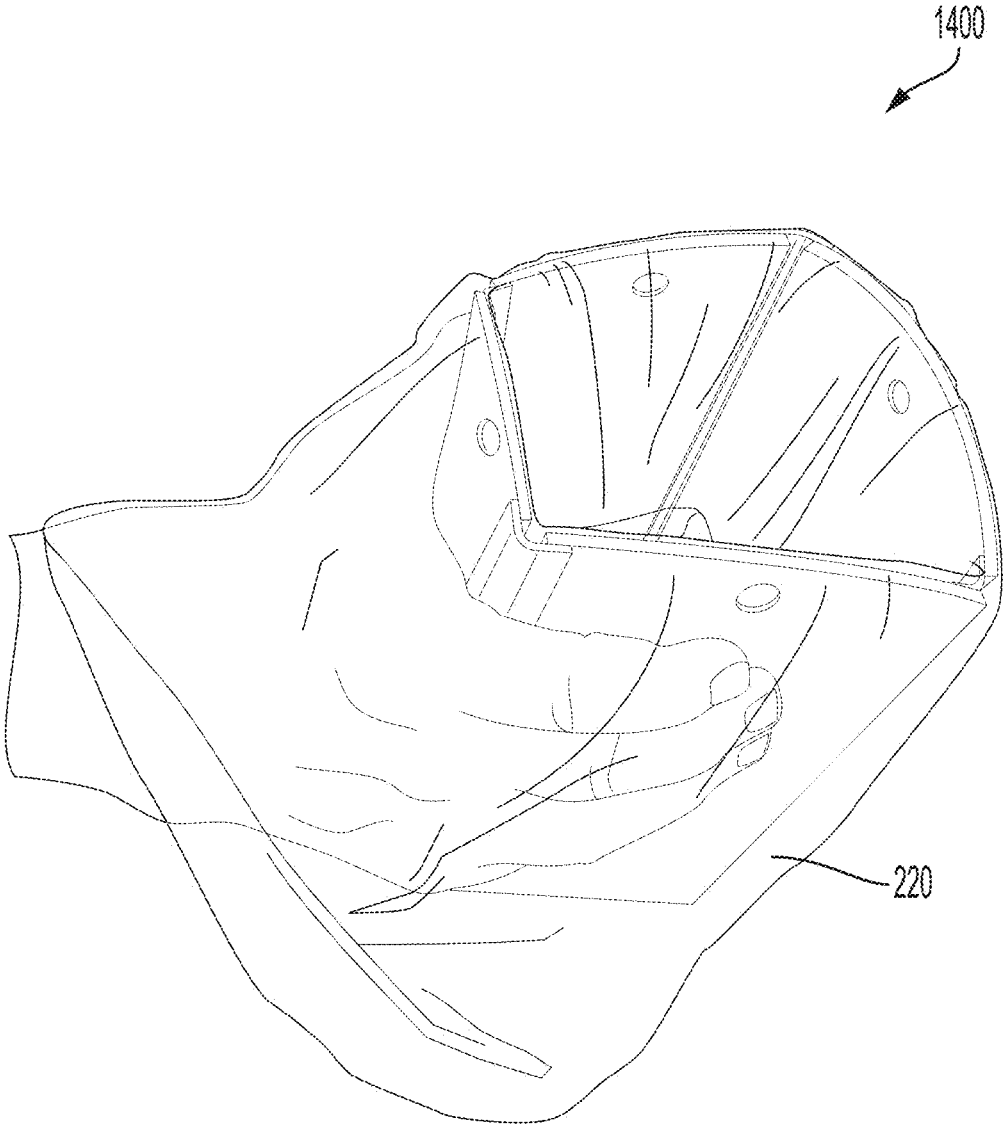
FIG. 14 shows a third operational view of the collection apparatus for containing and removal of animal waste with select kit components in an embodiment of the disclosure.

From there, the user may move on to the second operational step 1300 and the fourth operational step 1400. In the second operational step viewed in FIG. 13, the user may hold the collection apparatus 100 in the open position so that the bag 220 or other container can be placed inside the collection apparatus 100 to fill the interior void space 800. As such, the collection apparatus 100 is placed with the interior void space 800 at the top of the holding position of the user with the central void 700 located at the bottom of the held position. The bag 220 or other container is opened by the user with the other hand and then placed into the interior void space 800 as seen in FIG. 14 with the third operational step 1400. Here, the bag 220 or other contain completely fills the interior void space 800 and the excess of the bag 220 or other contain overlap the base edges of the plurality of panels 115 of the collection apparatus 100. In some instances, the excess of the bag 220 or other contain overlaps the user's hand gripping the collection apparatus 100 to help protect the user's hand from contacting the animal waste as it is collected into the collection apparatus 100.

Figure 15:
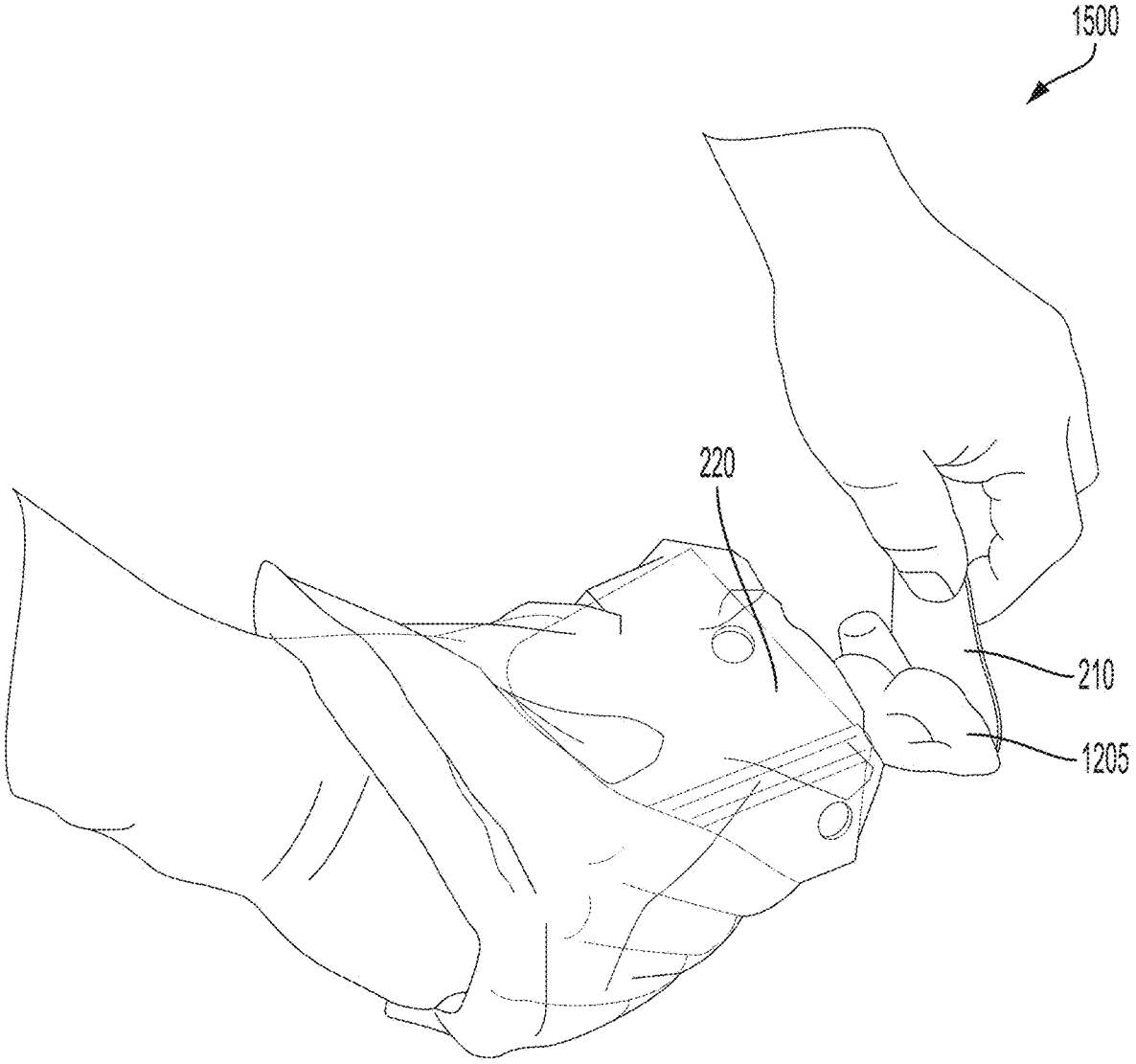
FIG. 15 shows a fourth operational view of the collection apparatus for containing and removal of animal waste with select kit components in an embodiment of the disclosure.
Figure 16:
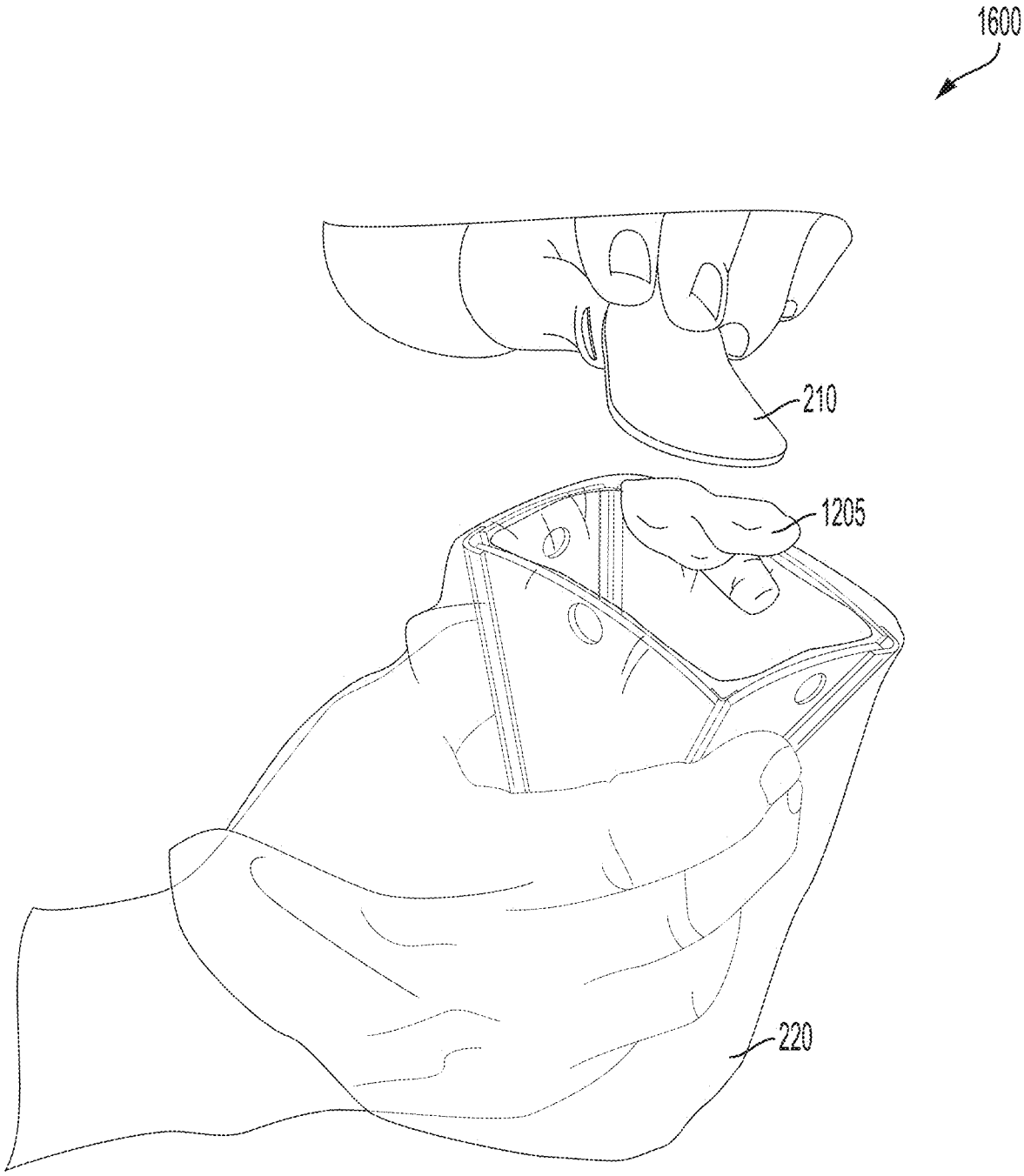
FIG. 16 shows a fifth operational view of the collection apparatus for containing and removal of animal waste with select kit components in an embodiment of the disclosure.

Next, in the fourth operational step 1500 viewed in FIG. 15, the collection apparatus 100 is ready to collect the animal waste from the ground area. The user hand gripping the collection apparatus 100 places the collection apparatus 100 onto the ground area where one panel of the plurality of panels 115 contacts the ground area surface. With the user's other hand, the scraper 210 is gripped. With the user's other hand, the scraper 210 is manipulated to move the animal waste 1205 into interior void space 800 of the collection apparatus 100 and in turn the bag 220 or another container to house the animal waste 1205 for ultimate disposal. The user will then turn the collection apparatus 100 back to an upright position in the fifth operational step 1600 viewed in FIG. 16. Once the animal waste 1205 is located within the bag 220 or other container lining the interior void space 800 of the collection apparatus 100, the scraper 210, being of an envisioned disposable nature, can be placed within the bag 220 or another container within the interior void space 800 with the animal waste so that that scraper 210 as well can be properly discarded. The scraper 210 does not have to be included with the animal waste 1205 within the bag 220 or container at this step in the operational process, but the inventor has found that this is an easier disposal method during operational use. Thus, the collection process of the animal waste within the collection apparatus 100 is complete.

Figure 17:
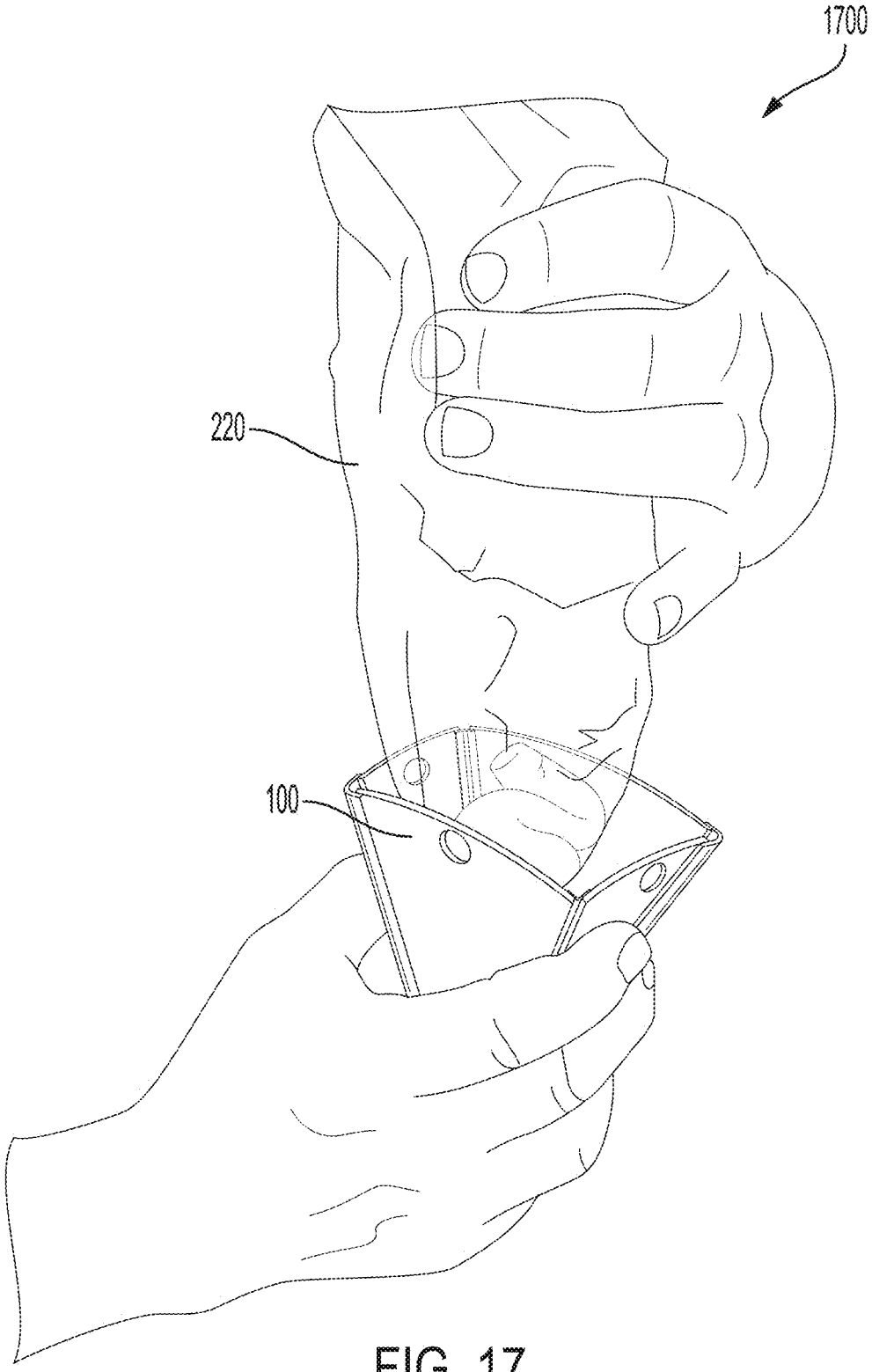
FIG. 17 shows a sixth operational view of the collection apparatus for containing and removal of animal waste with select kit components in an embodiment of the disclosure.

The user can then turn to securing the collected animal waste and scraper 210 as viewed in the sixth operational step 1700 seen in FIG. 17. With the animal waste and scraper 210 within the bag 220 or other container, the collection apparatus 100 in the upright position holds the animal waste and scraper 210 based on its tapered funnel shape. With one hand, the user continues to grasp the collection apparatus 100 to steady the contained animal waste and scraper 210 contained in the bag 220 or other container. With the user's other hand, the excess portion of the bag 220 or container that previously protected the user's hand gripping the collection apparatus 100 during collection of the animal waste is manipulated and pulled upward from its previous protective position covering the bases of the plurality of panels 115. Once all of the excess of the bag 220 is pulled upward, the user can then choose the best method to secure the bag containing the animal waste and scraper 210 to prevent leakage of the waste or the permeation of the associated smell of the animal waste. In some instances, the bag 220 or container may simply be twisted to reduce and minimize the surface area of the excess bag 220 or container. In other instances, the user may grasp the excess area of the bag 220 or container and tie that portion into a knot. Regardless, this operational step secures the animal waste and the scraper 210 within the bag 220 or another container. If a proper waste disposal container is nearby, the user may simply throw away the animal waste and scraper 210 at this operational step. However, it is likely that the outside walk or outing with the pet will continue on and then the user should move to the next operational step.

Figure 18:
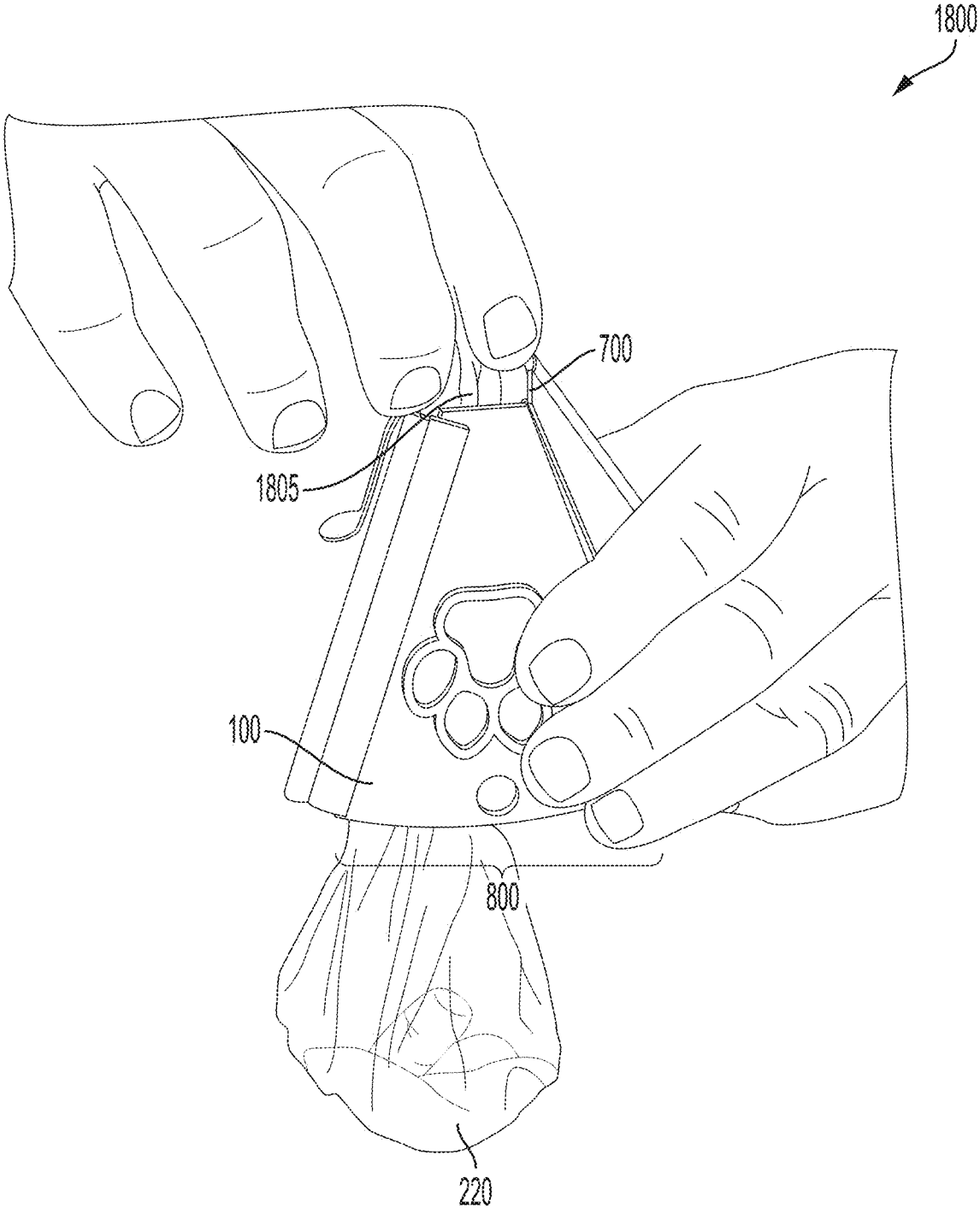
FIG. 18 shows a seventh operational view of the collection apparatus for containing and removal of animal waste with select kit components in an embodiment of the disclosure.
Figure 19:
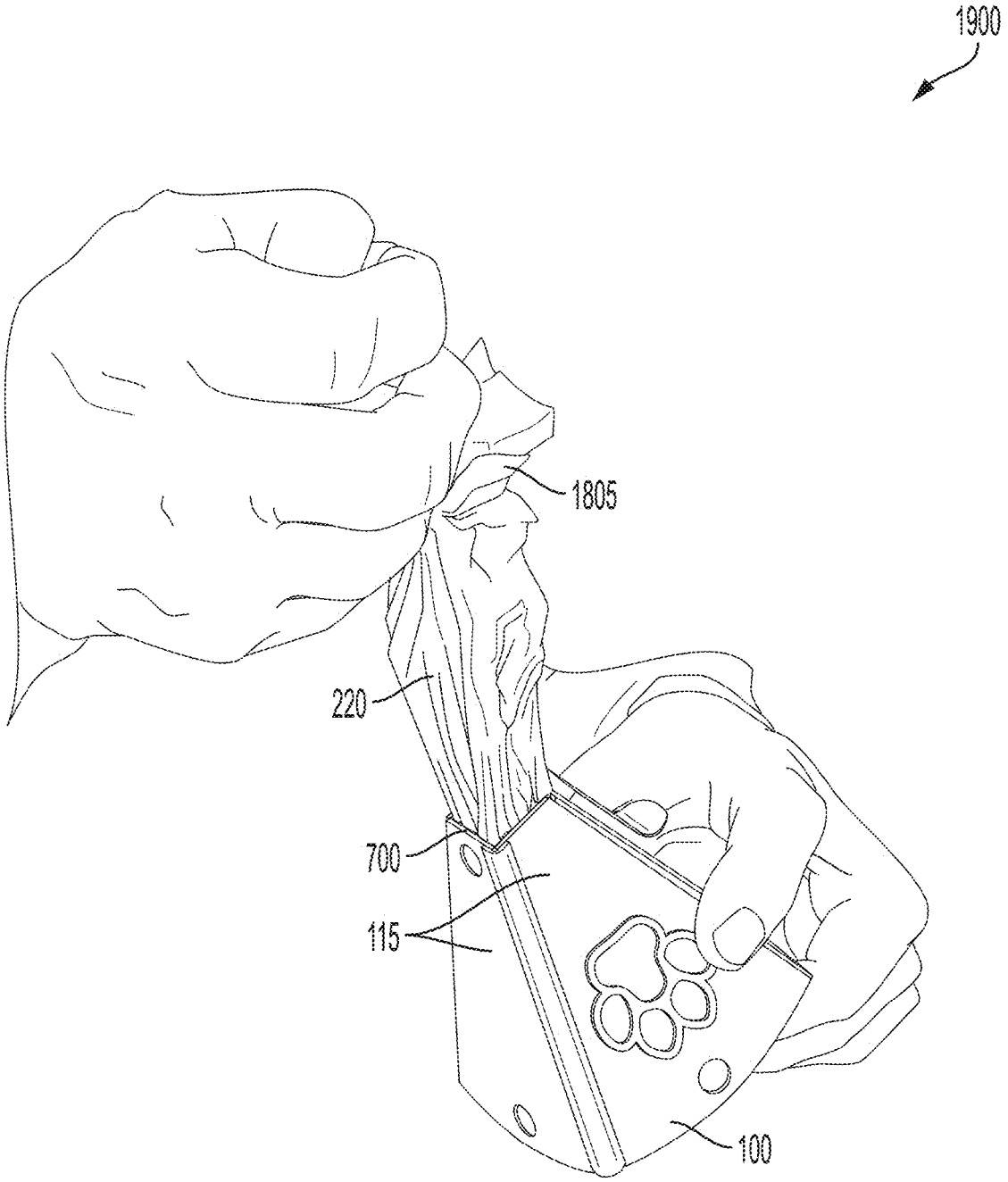
FIG. 19 shows an eighth operational view of the collection apparatus for containing and removal of animal waste with select kit components in an embodiment of the disclosure.

The seventh operational step 1800 of the collection apparatus 100 is viewed in FIG. 18. With the bag 220 or container secured, the user will then manipulate and rotate the collection apparatus 100 into a position opposite that which was used to collect the animal waste. In this second operational position, the collection apparatus 100 is held by the user where the central void 700 is located at the top and the interior void space 800 is located at the bottom when the collection apparatus 100 is grasped by the user. The bag 220 or container containing the animal waste and the scraper is positioned by the user in a fashion where the closed or secured portion of the bag 220 or container is at the top of its position and the portion of the bag 220 or container holding the animal waste and scraper 210 is located at the bottom. The user can then with the opposite hand feed the top secured bag position 1805 of the bag 220 or container through the middle of the interior void space 800 and up and through the middle of the central void 700 of the collection apparatus 100. Then, in the eighth operational step 1900 of FIG. 19, the user can use one hand to grasp the collection apparatus 100 while the other hand pulls the bag 220 or container from the top secured bag position 1805 through the central void 700 of the collection apparatus 100 so that the animal waste contained in the lower portion of the bag 220 or other container contacts the area of the plurality of panels 115 near the central void 700 and is contained within the interior void space 800 of the collection apparatus 100.

Figure 20:
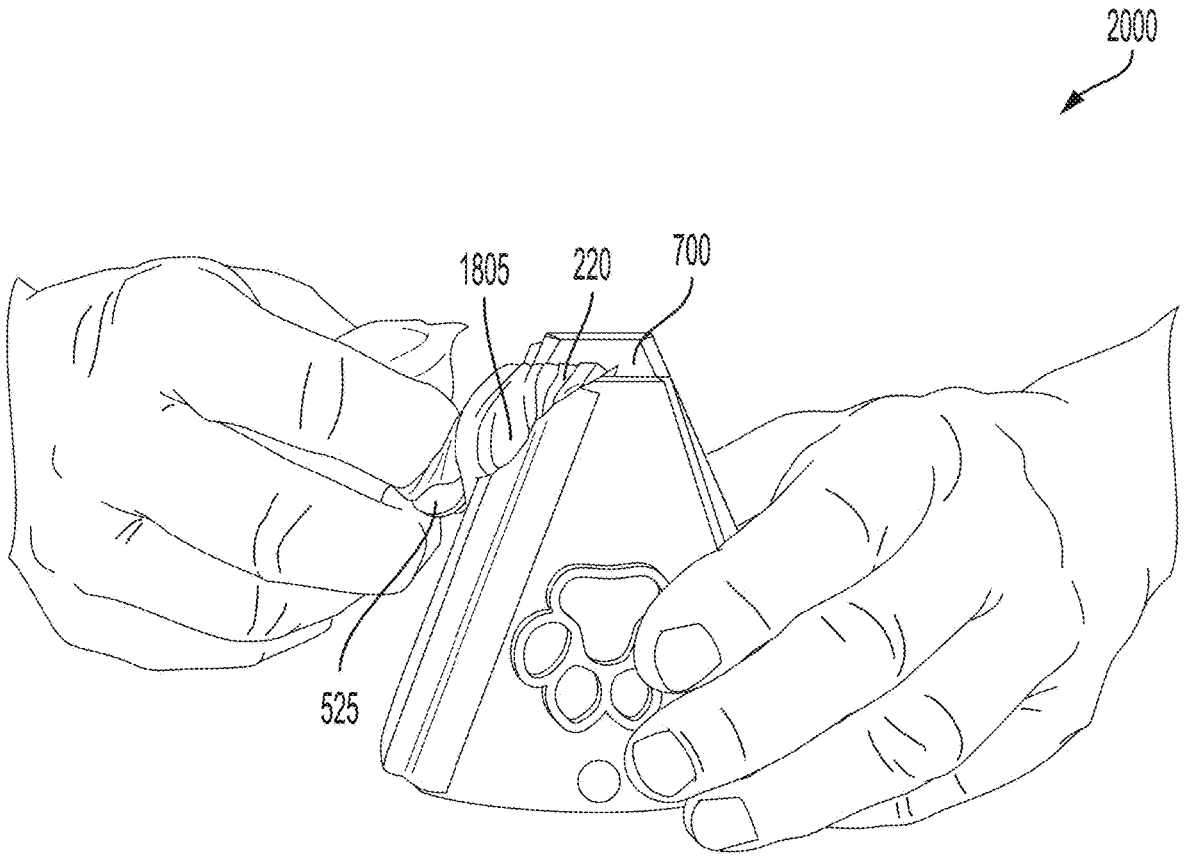
FIG. 20 shows a ninth operational view of the collection apparatus for containing and removal of animal waste with select kit components in an embodiment of the disclosure.

Finally, the user can execute the nineth operational step 2000 as viewed in FIG. 20. To ultimately secure the bag 220 or container to the collection apparatus 100, the user can grasp the collection apparatus 100 with one hand. With the user's other hand holding the bag 220 or container, the user can move and secure the top secured bag portion 1805 exiting the central void 700 so that it wraps around and is secured by the panel clip 525. In this operational step, the user may continue to twist or otherwise reduce the size of the top secured bag portion 1805 so that it can fit under and be secured by the panel clip 525. Once the bag 220 or container is secured, the animal waste has been collected and stored with use of the collection apparatus 100. The user can then continue along with the walk or outside outing with the pet until a point where the bag 220 or container holding the animal waste can be properly disposed of. If the walk is to be continued, the user may wish to store the collection apparatus 100 by way of a clip 205 through either the apex opening 320 or any of the first panel opening 335, second panel opening 420, third panel opening 520, or fourth panel opening 620. Generally, it is envisioned that use of the apex opening 320 with the clip would be the most ideal way to secure the collection apparatus 100 with the clip to a leash 215 or walking harness for the pet to allow for the collection apparatus 100 to act as a barrier to the animal waste secured within. Additionally, the user may wish to carry the bag 220 or container of the animal waste secured via the panel clip 525 in another carried parcel or purse. Regardless, the tenth operational step 2000 finalizes use of the collection apparatus 100 in collecting and storing the animal waste created by the pet during the outing. Once the bag 220 or container containing the animal waste is disposed of, the user can then manipulate the collection apparatus 100 back into the closed position so that it can be used again during the next walk or outdoor outing. The collapsed version of the collection apparatus 100 can then be stored simply in a parcel or purse or attached via the clip 205 traveling through and securing each the aligned first panel opening 335, second panel opening 420, third panel opening 520, and fourth panel opening 620 with one another to a leash 215. It is envisioned that the collection apparatus 100 can be used multiple times for collection and storage of the animal waste.

As various modifications could be made in the constructions and methods herein described and illustrated without departing from the scope of the invention, it is intended that all matter contained in the foregoing description or shown in the accompanying drawings shall be interpreted as illustrative rather than limiting. For example, the options described and available for the configuration of the plurality of panels and the number of panels of the collection apparatus may be adjusted in both size and number in various different collection apparatus models. Thus, the breadth and scope of the present invention should not be limited by any of the above-described example embodiments but should be defined only in accordance with the following claims appended hereto and their equivalents.

What is claimed is:

1. A collection apparatus for animal waste comprising:

a plurality of panels, each of the plurality of panels being a tapered shape wherein a base of each panel is a greater width than an apex of each panel;

a plurality of hinges connecting a panel of the plurality of panels to an adjacent panel of the plurality of panels, the plurality of hinges allowing for movement of the plurality of panels in respect to one another by way of their connection to the plurality of hinges;

a first opening located at a top of the collection apparatus, the first opening defined by an apex width of each apex of each panel of the plurality of panels;

a second opening located at a bottom of the collection apparatus, the second opening defined by a base width of each base of each panel of the plurality of panels;

a first position of the collection apparatus being an expanded position wherein the plurality of panels and the plurality of hinges are spaced apart from one another to create the first opening and the second opening of the collection apparatus; and a second position of the collection apparatus, the second position being a collapsed position wherein the first opening and the second opening of the collection apparatus are not present in the collapsed position;

wherein the plurality of hinges includes a first hinge and a second hinge;

wherein when the collection apparatus is in the first position, the first hinge is opposite the second hinge in the expanded position; and wherein when the collection apparatus is in the second position, the first hinge is approximate and envelops the second hinge in the collapsed position.

2. The collection apparatus of claim 1, wherein the first hinge and the second hinge attach to an exterior area of their adjacent panels of the plurality of panels.

3. The collection apparatus of claim 2, further comprising a third hinge and a fourth hinge, the third hinge and the fourth hinge attach to an interior area of their adjacent panels of the plurality of panels.

4. The collection apparatus of claim 1, further comprising a panel clip secured to at least one of the plurality of panels.

5. The collection apparatus of claim 1, further comprising an apex opening, the apex opening located on at least one of the plurality of panels approximate the apex of the respective panel.

6. The collection apparatus of claim 1, further comprising a plurality of panel openings, the plurality of panel openings being located on each of the plurality of panels approximate the base of each respective panel.

7. The collection apparatus of claim 6, wherein the plurality of panel openings are located in a middle of the base width, and wherein when the collection apparatus is in the second position, the plurality of panel openings align with one another to create a common through space.

8. The collection apparatus of claim 1, wherein the plurality of panels includes a first panel, a second panel, a third panel, and a fourth panel connectable to one another via the plurality of hinges.

9. The collection apparatus of claim 8 wherein at least one of the first panel, second panel, third panel, or fourth panel contains a design in a middle of the panel, the design protruding out from an exterior area of the respective panel to provide a gripping surface for a user of the collection apparatus.

10. A kit for collecting and storing animal waste, the kit comprising:

a clip;

a scraper; and a collection apparatus, the collection apparatus comprising;

a plurality of panels, each of the plurality of panels being a tapered shape wherein a base of each panel is a greater width than an apex of each panel;

a plurality of hinges connecting a panel of the plurality of panels to an adjacent panel of the plurality of panels, the plurality of hinges allowing for movement of the plurality of panels in respect to one another by way of their connection to the plurality of hinges;

a first opening located at a top of the collection apparatus, the first opening defined by an apex width of each apex of each panel of the plurality of panels;

a second opening located at a bottom of the collection apparatus, the second opening defined by a base width of each base of each panel of the plurality of panels;

a first position of the collection apparatus being an expanded position wherein the plurality of panels and the plurality of hinges are spaced apart from one another to create the first opening and the second opening of the collection apparatus; and a second position of the collection apparatus, the second position being a collapsed position wherein the first opening and the second opening of the collection apparatus are not present in the collapsed position; and a panel clip secured to at least one of the plurality of panels of the collection apparatus operable to secure the scraper.

11. The kit for collecting and storing animal waste of claim 10, wherein the plurality of hinges of the collection apparatus includes a first hinge and a second hinge;

wherein when the collection apparatus is in the first position, the first hinge is opposite the second hinge in the expanded position; and wherein when the collection apparatus is in the second position, the first hinge is approximate and envelops the second hinge in the collapsed position.

12. The kit for collecting and storing animal waste of claim 10, further comprising an apex opening of the collection apparatus, the apex opening located on at least one of the plurality of panels approximate the apex of the respective panel.

13. The kit for collecting and storing animal waste of claim 12, wherein the clip travels through the apex opening and is connectable to the collection apparatus via the apex opening when the collection apparatus is in the first position.

14. The kit for collecting and storing animal waste of claim 10 further comprising a plurality of panel openings on the collection apparatus, the plurality of panel openings located on each of the plurality of panels approximate the base of each respective panel on the collection apparatus.

15. The kit for collecting and storing animal waste of claim 14, wherein the plurality of panel openings on the collection apparatus are located in a middle of the base width, and wherein when the collection apparatus is in the second position, the plurality of panel openings align with one another to create a common through space.

16. The kit for collecting and storing animal waste of claim 15, wherein the clip travels through the common through space created by the alignment of the plurality of panel openings and is connectable to the collection apparatus via the aligned plurality of panel openings when the collection apparatus is in the second position.

17. A method of collecting and securing animal waste by a user, the method comprising:

providing a collection apparatus with a plurality of panels, each of the plurality of panels being a tapered shape wherein a base of each panel is a greater width than an apex of each panel, the collection apparatus having a plurality of hinges connecting a panel of the plurality of panels to an adjacent panel of the plurality of panels, the plurality of hinges allowing for movement of the plurality of panels in respect to one another by way of their connection to the plurality of hinges, a first opening of the collection apparatus defined by a apex width of each apex of each panel of the plurality of panels and a second opening defined by a base width of each base of each panel of the plurality of panels, and a first position of the collection apparatus being an expanded position wherein the plurality of panels and the plurality of hinges are spaced apart from one another to create the first opening and the second opening of the collection apparatus, and a second position of the collection apparatus being a collapsed position wherein the first opening and the second opening of the collection apparatus are not present in the collapsed position;

moving the collection apparatus from the second position to the first position and gripping the collection apparatus by the user in the first position;

placing a container into an interior void space of the collection apparatus through the second opening of the collection apparatus in the first position, wherein the container fills the interior void space from the second opening to the first opening of the collection apparatus;

placing the collection apparatus with the container on a ground surface near an animal waste;

manipulating via a scraper the animal waste into the container contained within the interior void space of the collection apparatus;

removing the container from the interior void space of the collection apparatus;

securing a top portion of the container to maintain confinement of the animal waste within the container;

navigating the top portion of the container through each the second opening and the first opening of the collection apparatus; and securing the top portion of the container to the collection apparatus via a panel clip located on at least one panel of the plurality of panels of the collection apparatus.

18. The method of collecting and securing animal waste of claim 17, further comprising attaching the collection apparatus securely containing the container with the animal waste to a leash by way of a clip, the clip traveling through and attaching to both the leash and the collection apparatus by either an apex opening of the collection apparatus located near the first opening of the collection apparatus or through one of a plurality of panel openings located near the second opening of the collection apparatus.

* * * * *